US010271610B2

(12) United States Patent
Henkel

(10) Patent No.: US 10,271,610 B2
(45) Date of Patent: Apr. 30, 2019

(54) FLEXIBLE AND PRECISELY FITTING SKI BOOT FOR MAXIMUM EFFICIENCY AND FOOT AND LEG HEALTH DURING NORDIC SKIING

(76) Inventor: Heidi Henkel, Putney, VT (US)

( * ) Notice: Subject to any disclaimer, the term of this patent is extended or adjusted under 35 U.S.C. 154(b) by 175 days.

(21) Appl. No.: 13/880,555

(22) PCT Filed: Oct. 21, 2011

(86) PCT No.: PCT/US2011/057261

§ 371 (c)(1),
(2), (4) Date: Apr. 19, 2013

(87) PCT Pub. No.: WO2012/054819

PCT Pub. Date: Apr. 26, 2012

(65) Prior Publication Data

US 2013/0212910 A1 Aug. 22, 2013

Related U.S. Application Data

(60) Provisional application No. 61/405,342, filed on Oct. 21, 2010.

(51) Int. Cl.
*A43B 5/04* (2006.01)
*A43B 7/20* (2006.01)

(52) U.S. Cl.
CPC ..... *A43B 5/0411* (2013.01); *A43B 5/046* (2013.01); *A43B 5/0472* (2013.01); *A43B 7/20* (2013.01)

(58) Field of Classification Search
CPC ... A43B 5/0411; A43B 5/0413; A43B 5/0472; A43B 5/0407; A43B 5/0474; A43B 5/0492; A43B 5/0494; A43B 5/0496
(Continued)

(56) References Cited

U.S. PATENT DOCUMENTS 2,172,669 A * 9/1939 Taft ..... A63C 9/02 280/614
3,419,974 A * 1/1969 Lange ..... 36/117.6
(Continued)

FOREIGN PATENT DOCUMENTS

CA 2209836 C 3/2001
WO 2007150068 A2 12/2007

OTHER PUBLICATIONS

PCT Search Report & Written Opinion for PCT Application No. PCT/2011/057261, dated May 8, 2012, 8 pages.

*Primary Examiner* — Jila M Mohandesi
(74) *Attorney, Agent, or Firm* — Maine Cernota & Rardin

(57) ABSTRACT

A comfortable, flexible Nordic ski boot with embodiments for classic, skate, combi, and roller skiing enables full ski control while remaining comfortable and allowing movement to help avoid overuse injuries including compartment syndrome. The boot provides precise fit at the heel and ball of the foot while allowing flexible movement. In embodiments, a strap attaches the ball of the foot. A custom heel fit and/or a strap can attach the heel. A removable, adjustable cuff can limit eversion and inversion. Some embodiments are made on multiple lasts, provide toe box room, provide partial or full movement about the ball of the foot, and/or allow twisting between the heel and ball of the foot. Embodiments are configured to elastically return to a flat configuration after flexing, while remaining in alignment with a ski. The sole can include carbon fibers and/or elastic cords, spring cables, and/or such like to enhance elasticity.

27 Claims, 28 Drawing Sheets

(58) Field of Classification Search
USPC ..... 36/117.1–117.8, 115, 116, 114, 51, 50.5
See application file for complete search history.

(56) References Cited

U.S. PATENT DOCUMENTS 3,701,208 A * 10/1972 Dalebout ..... 36/117.6
4,186,500 A * 2/1980 Salzman ..... A43B 5/0411 280/615
4,259,791 A * 4/1981 Bazan ..... 36/7.2
4,281,468 A * 8/1981 Giese et al. ..... 36/119.1
4,487,427 A * 12/1984 Salomon ..... A63C 9/20 280/615
4,505,056 A * 3/1985 Beneteau ..... 36/117.2
4,724,627 A * 2/1988 Sisco ..... A43B 7/28 36/117.6
4,756,096 A * 7/1988 Meyer ..... A43B 7/28 12/142 N
4,788,780 A * 12/1988 Boggs ..... A43B 3/16 36/117.2
4,920,665 A 5/1990 Pack et al.
5,177,884 A * 1/1993 Rullier ..... A43B 5/0411 36/114
5,518,264 A * 5/1996 Broughton ..... A43B 5/0492 280/615
5,692,321 A * 12/1997 Holstine ..... 36/93
5,897,127 A * 4/1999 Hauglin ..... A43B 5/0492 280/613
6,082,768 A * 7/2000 Johnson ..... A63C 17/045 280/11.3
6,098,317 A * 8/2000 Lazzaroni ..... A43B 5/0411 36/101
6,189,172 B1 * 2/2001 Baek ..... 12/142 P
6,202,326 B1 * 3/2001 Hauglin ..... 36/117.2
6,247,252 B1 * 6/2001 Parisotto ..... 36/118.7
6,390,439 B1 * 5/2002 Cordes et al. ..... 249/119
6,453,580 B1 * 9/2002 Lancon ..... 36/117.2
6,644,683 B1 * 11/2003 Hauglin et al. ..... 280/613
6,694,644 B2 * 2/2004 Haupt ..... 36/50.5
6,708,425 B2 * 3/2004 Parisotto ..... 36/118.2
7,231,729 B2 * 6/2007 Heierling ..... A43B 5/04 36/117.3
7,428,789 B2 * 9/2008 Holzer et al. ..... 36/88
7,614,638 B2 * 11/2009 Cunningham et al. ..... 280/617
7,618,054 B2 * 11/2009 Cunningham et al. ..... 280/617
7,874,573 B2 * 1/2011 Cunningham et al. ..... 280/617
8,215,660 B2 * 7/2012 Cunningham et al. ..... 280/617
D667,200 S * 9/2012 Jones ..... D2/896
2007/0075523 A1 * 4/2007 Len ..... 280/602
2008/0104864 A1 * 5/2008 Hall et al. ..... 36/117.1

* cited by examiner

FLEXIBLE AND PRECISELY FITTING SKI BOOT FOR MAXIMUM EFFICIENCY AND FOOT AND LEG HEALTH DURING NORDIC SKIING

RELATED APPLICATIONS

This application is a national phase entry of PCT application PCT/US2011/057261, which is herein incorporated by reference in its entirety for all purposes. PCT application PCT/US2011/057261 claims the benefit of U.S. Provisional Application No. 61/405,342, filed Oct. 21, 2010 which is herein incorporated by reference in its entirety for all purposes.

FIELD OF THE INVENTION

The invention relates to sporting equipment, and more particularly, to Nordic Ski boots.

BACKGROUND OF THE INVENTION

Nordic ski boots and bindings for skating have existed since at least 1989. Generally, the features included in the boots and bindings are provided mainly to enable the boot to precisely control the ski. These features can include having one or more large ridges or grooves running the length of the ski, and/or a horizontal metal bar under the toe. The soles and cuffs of the boots are typically very stiff, so as to allow only one plane of motion in the ankle in a very limited range of motion (plantar flexion/dorsiflexion).

The quest to give the skier more control of the ski via the boot has also led to boots with very narrow toe boxes, and to the "Pilot" boot-binding systems. Other than the Pilot systems, there are two basic boot-binding types: the "profil" (one large wide groove runs the length of the sole of the boot and fits like puzzle pieces with a similar raised part on the binding); and the "NNN" (two smaller grooves on the sole of the boot fit like puzzle pieces with a similar raised pattern on the binding). Nordic ski boots are generally made of rigid materials, and are rigid in many locations on various boots, especially skate boots. Many of these Nordic boots attempt to imitate the control of the ski of Alpine ski technology, by imitating some of the features of Alpine ski boots, particularly regarding stiffness.

Each Nordic boot company has a "typical" proportion, which runs throughout their boots. Boots are generally made in skate, classic, and combi/pursuit versions. Nordic skiers complain of uncomfortable feet from too-tight toe boxes and poorly fitting boots. Some people who would like to Nordic ski do not, because they cannot find a boot which they are comfortable wearing.

Existing Nordic ski boots contribute to stresses which can lead to overuse injuries. In particular, there has also been a steep rise in the incidence of chronic exertional compartment syndrome in Nordic ski racers, particularly in Juniors (19 and younger) and in sponsored (professional) athletes. This syndrome is referred to by Nordic skiers as "compartment syndrome." It is a serious overuse injury of the lower leg in which a buildup of fluid and inflammation fills one or more of the fascial compartments of the lower leg, to the extent that the compartment is completely full and experiences a significant amount of pressure. The fluid cannot escape because the blood and lymph vessels are compressed and unable to function. In many cases, skiers with compartment syndrome require surgery, often multiple times, with a long recovery period following each surgery. There has been very little knowledge of what to do about compartment syndrome, particularly for prevention.

What is needed, therefore, is a Nordic ski boot which provides excellent ski control while at the same time significantly reducing the risk of compartment syndrome.

SUMMARY OF THE INVENTION

Nordic ski skating is a popular sport that is related to classic Nordic skiing but nevertheless provides different challenges and rewards. As illustrated in FIGS. 1A and 1B, roller ski skating (FIG. 1A) is typically performed on pavement using a ski 100 that is supported by rollers 102, while snow ski skating (FIG. 1B) is typically performed on snow or ice on a ski without rollers. While related, it is clear that roller ski skating and snow ski skating place different stresses on the feet, ankles, and legs if the skier. In roller ski skating, the height 104 of the foot 106 above the pavement 108 is much greater than the height 110 of the foot 106 above the snow or ice 112 in snow ski skating. As shown in the rear views of FIGS. 1C and 1D, the radius 114 about the axis of inversion and eversion 120 for roller ski skating is much greater than the axis 120 for snow ski skating. For snow ski skating (FIG. 1D), the axis of inversion and eversion is different for soft snow 122 and for ice 124.

In skate roller skiing the longer radius of inversion and eversion 114 leads to very high torque forces on the ankle 116 of the skier if the skier falls or "turns" his or her ankle, and also leads to a requirement for smaller eversion angles during normal skate roller skiing. In snow skate skiing the shorter radius of inversion and eversion 120 causes the torque on the ankle 116 due to any mishap to be very small, while the typical eversion movements during normal snow skate skiing are larger than for roller skate skiing.

The present invention is a Nordic ski boot that fits comfortably and significantly reduces the risk of compartment syndrome by allowing limited movement of the foot in certain directions, while at the same time providing precise control of the ski. Ski control is achieved in the present invention by precise fitting of the boot to the foot in locations where precise fitting is not hard on the foot, whereas prior art boots depend upon tightness in inappropriate places and/or unnecessary boot stiffness. The boot fits the foot precisely in the heel and in the ball of the foot, which are locations where a precise, firm fit can be accomplished without compromising movement or comfort of the foot. In embodiments, this precise fitting to the foot includes a strap across the ball of the foot which can be adjusted to the skier's desired tension, and a custom-fit heel. In this way, the boot does not excessively immobilize the foot or ankle, and it fits comfortably. In some embodiments the boot allows full movement in all the ways that a human foot naturally moves and with no limits on normal ranges of movement, although lateral flexion in the sole of the boot, which is not a normal movement of the human foot, is prevented.

The Nordic ski boot of the present invention is based at least in part upon a novel realization of the causes of compartment syndrome and of other foot and leg injuries, which arise at least in part from unnatural skiing movements which are forced upon the skier by the rigidity of prior art boot designs. In particular, the present invention reduces the risk of compartment syndrome by enabling the skier to modify his or her skiing technique in a manner which avoids the stresses to the lower leg that cause compartment syndrome. The skiing technique modifications which are most helpful in alleviating the stresses on the lower legs that contribute to compartment syndrome and other injuries are as follows.

First, the skier needs to avoid chronic outward rotation of the foot at the ankle joint. Outward rotation at the ankle joint puts a huge stress on the muscles of the anterior and lateral lower leg, where compartment syndrome is typically most severe. Instead, the skier should outward rotate at the hip only, and not at the ankle, so that the lower leg is much more relaxed. The knee and the toe should both point the same direction. This not only greatly decreases the stress on the compartments of the lower leg, it makes for faster skiing, because the leg can produce more power when in good alignment. It also reduces stress on the knee.

The problem is, in a typical stiff boot of the prior art it can be difficult or impossible to put the ski on edge in order to push off. Because these prior art boots are so stiff, skiers are forced to deviate their knee medially in order to edge the ski, because they cannot do the edging via ankle/foot eversion because of the stiffness of the boot.

In order to put the ski on edge via a valgus knee movement, a skier using a typically prior art ski boot must inward rotate at the hip, while leaving the foot outward rotated because that is the direction of the ski. The stiffness of the prior art boot requires the skier to twist his or her entire leg in an unnatural way in order to edge their ski, and this involves ankle outward rotation and a valgus knee position, putting extreme stress on the anterior and lateral compartments and putting some stress on the knee.

Skiers using typical prior art Nordic boots are forced to do this even on flat terrain. In order to edge the ski, they are required to constantly ski in this manner. The present invention eliminates this necessity, by enabling the skier to simply edge by moving his or her foot and ankle in eversion—which cannot be done in a typical prior art boot because of boot stiffness. Using the boot of the present invention, it is even possible to skate ski up steep hills while maintaining the leg in a normal, healthy alignment.

Avoiding valgus movement of the knee is important both for preventing compartment syndrome and for preventing strain to the medial collateral ligament of the knee. The same technique of edging via ankle and foot movements rather than with outward rotating at the ankle is useful for both purposes. This technique also allows a skier to produce more power in the push-off, because muscles function more effectively for power production in a leg that is aligned in a manner that is consistent with how the muscles are designed to produce force.

Another technique feature that helps alleviate compartment syndrome is the follow through principle. When a ball is thrown, the arm keeps going in the same direction after the ball is released, and continues to the full extension of the movement in a relaxed manner, even though the ball is released before the arm reaches full extension. This is the most efficient and healthy way to perform any high-speed movement. When skating at high speeds, the leg needs to execute complete movements. However, such complete movements are not possible using typical prior art boots, due to their excessive stiffness. Stopping such a movement before its full extension causes tension and stress on the lower leg.

When skating at fast speeds, such as on gradual downhill slopes, it is especially important for a skier to be able to complete a follow through movement. A skier wearing boots of the present invention can complete each follow through movement with the foot on or off of the snow, depending on the skier's philosophy about technique. Either way, enablement by the present invention of the plantar flexion of the foot helps to keep the fascial compartments of the lower leg fluid and mobile. In addition to the obvious stretching of the anterior tibialis as the ankle goes into plantar flexion, the fibula inward rotates relative to the tibia when the ankle plantar flexes. This gives deep movement all the way up the lower leg, helping all the compartments remain fluid and flexible. Follow through movement also allows the functional part of the movement to be at a faster velocity than otherwise. The use of more plantar flexion when skate skiing at faster speeds also requires more flex in the ball of the foot than in prior art, so that the ski rides smoothly across the snow.

The narrow toe boxes of some prior art boots can also cause tension in the lower leg. This can be seen by simply squeezing the toes of one foot, and then attempting to move the foot and ankle. It will be apparent that squeezing of the toes leads to significant tension in the lower leg when movement of the foot and ankle is attempted. In addition, anytime there is pain, the body responds with muscle tension in the immediate vicinity and in surrounding tissue. This is an automatic reflex that works to immobilize acute injuries to prevent further damage. The narrow toe boxes of some prior art boots very often cause pain in the foot, leading to muscle tension in the foot and leg. This leads to other physiological changes that eventually develop into compartment syndrome. A narrow toe box, as well as uncomfortable fitting of a boot in general, thereby contributes to compartment syndrome by creating pain and tension in the foot and lower leg.

In general, chronic tension and lack of motion in the muscles of the lower leg contribute to compartment syndrome. One reason is that chronic tension leads to inflammation, and also tends to prevent inflammation from dissipating. Veins and lymph vessels are impeded in their functions when they are surrounded by stiff, tense muscles. Veins require the assistance of muscles which are relaxed and in motion in order to transport blood and participate in healthy circulation, and muscles that are stiff and tense therefore pose a challenge.

The other way that tension can lead to compartment syndrome is through lack of motion. When a muscle is tense, it tends to be less mobile, and this lack of movement creates ionic bonds in the fascia, making the fascia less fluid and less functionally elastic. The fascia then have less ability to expand to accommodate increases in blood volume in the lower leg during intense exercise. Direct immobilization of the ankle joint by the boot also has this effect. If fascial tissue is immobilized for a period of time, it forms more ionic bonds and becomes more rigid and solid, and therefore is less able to expand and adapt to changes in demands during exercise. When, during exercise, a large blood volume tries to get through muscles that are in the stiffened fascia, there is not enough room. There is also not enough room for inflammation to be transported out of the compartments. The stiffened fascia end up blocking the blood and lymph vessels from transporting fluids, leaving the fluids stuck in the compartments. Rigid immobilization of the ankle joints of Nordic skiers by typical prior art ski boots therefore contributes directly to the likelihood of compartment syndrome.

Classic and skate embodiments of the present invention provide precise control of the ski without the rigid, comprehensive immobilization, tension, and discomfort of typical prior art boots. Some embodiments also provide high precision in turning when downhill skiing. In some embodiments, only minimal force is required to flex the boot in the region of the ball of the foot. The stiffness of many prior art boots in this region isn't useful if the user's feet are strong, and stiffness in this region can be problematic for the movements of classic skiing.

The prior art Pilot binding has the goal of making the boot snap back to the ski more precisely and quickly, but it has the disadvantage of causing the ski to have too much ability to apply torque to the foot during falls. This is because the binding has two different points of contact between the ski and the boot, without a release mechanism. The same goal is achieved in embodiments of the present invention by providing an energetic spring-back to flatness in the sole of the boot itself, and/or by providing lateral rigidity which causes the boot land accurately on the binding.

As mentioned above, the boot of the present invention fits comfortably, allows movement, and still creates precise control of the ski. Its precision arises from providing two points of firm contact between the foot and the boot, one at the heel and one at the ball of the foot. These are both locations where the fit can be made very precise without limiting the motion of the foot, and without making the foot uncomfortable or confined. The firm contact is provided by a strap across the ball of the foot that can be adjusted to the skier's desired tension, and a custom-fit heel. In this way, the boot of the present invention does not excessively immobilize the foot or ankle, and it fits comfortably.

In embodiments, the strap across the ball of the foot is approximately an inch wide, and can be slightly wider or narrow depending on the overall boot size, and in various embodiments it is sewn to a wider swath of fabric on each end, which tapers to the strap. In certain embodiments the strap is made of webbing, and attaches adjustably like a bicycle helmet, backpack, or automotive roof rack strap. In other embodiments it is a Velcro strap, or has a ratcheting device (which in some embodiments is made at least partly out of plastic). Still other embodiments include other fastening methods known in the art. The material of the strap does not stretch appreciably, and adjustments thereof can be made precisely and customized daily by the user.

In certain embodiments intended for high performance, the strap is sewn onto the boot in a custom location according to an intended skier's anatomy, including the exact location of the ball of the skier's foot. This is done by the skier putting on the boot and the salesperson pressing on the outside of the boot so as to find the bony landmarks of the joints proximal to the big and little toes. The strap is then sewn to the boot at the store, or the boot is appropriately marked and sent to the factory to be sewn.

In other embodiments, the strap is custom fit by using a mechanism that enables the user to adjust the placement of the strap fore and aft on the boot. This has the advantage that the skier can experiment with placement of the strap. In addition, if the boots are ever re-sold, the next user can make a different adjustment more easily and cheaply than if the strap must be re-sewn.

The other precise and firm point of contact is made by a custom-fit heel. In some embodiments this is accomplished using a moldable interior material located just in the heel region of the boot, as is currently done with the entire interior of most Telemark boots. In other embodiments the precise and firm fitting of the heel is accomplished using a technology similar to an air cast, with an inflatable pocket around the sides and rear of the heel, which can be inflated for each use. A strap extends from a bottom rear location on one side of the heel, over the proximal top of the foot, and down to a bottom rear location on the other side of the heel, thereby helping to maintain the heel securely positioned in the boot.

In various embodiments, the inside of the hard plastic sole of the boot and the insole are slightly concave in the heel, so as to fit the heel of the foot. And in some embodiments the insoles are moldable to the shape of the foot.

The boots of the present invention are also comfortable to wear. In some embodiments, the boots are made on two or more different lasts, one being narrower than the other. This manufacturing approach is new and unique to the Nordic boot art. In various embodiments the material of the forefoot, including the toe box, is custom moldable. And in certain embodiments the toe box is comfortable and is not a source of steering precision.

The shape of the last in various embodiments enhances both foot health and edging and precision of steering of the ski, by allowing the big toe to go straight forward from the foot. This way, the boot is not putting the typical strain on the big toe that causes bunions and stresses the arch, and the big toe is in a position to be actively involved in edging the ski and helping to steer the ski.

There is no hard arch support in embodiments of the invention, either in the sidewall or in the insole of the boot. Arch supports can create a level of immobilization of the foot that is harmful to the functioning of many peoples' feet, creating tension, creating ionic bonds in fascia, and preventing normal functioning and movement of the arch of the foot during movement. In other embodiments, arch supports are provided for users who require them, or arch supports obtained from a third party such as a doctor or a pharmacy can be added to the boots as needed.

In certain embodiments the sole of the boot has a pattern on the bottom which makes it compatible with existing binding systems. The NNN binding-boot sole combination is the most ideal existing binding-sole combination for this invention. In these embodiments the pattern is on the heel and on the forefoot, and there is an area of the mid-foot that does not have a pattern. This makes it easier for there to be different movement and non-movement characteristics in the three sections of the sole of the boot.

Embodiments of the boots of the present invention include other unique features which facilitate normal, healthy foot movements and therefore healthier and more effective skiing movements. These features differ somewhat between the different embodiments of the boot.

Various embodiments are configured for use in different forms of Nordic skiing, and for use by skiers with different needs and priorities. For example, there are embodiments for skate, classic, combi/pursuit, and roller skiing, and among some of these embodiments there are different embodiments for skiers who want more ankle support, and for skiers with strong feet and ankles whose priority in a boot is light weight and maximal freedom of movement.

In various embodiments, the sole of the boot is stiff from the ball of the foot to the binding, so as to transfer the foot movement precisely to the binding. The ball of the foot of some skate boot embodiments is flexible just in the vertical direction, and just through a partial toe extension. In these embodiments the sole springs back energetically to a flat configuration as soon as the force that bends the ball of the foot is removed. The sole also has the ability in various embodiments to twist between the front of the heel and the ball of the foot, and springs back to its original flatness as soon as the force causing it to twist is removed. This sole design allows skier to do foot eversion at the mid-foot (this is where most foot eversion happens anatomically, in the joints between the tarsal bones and between the tarsals and metatarsals) and to weight the joint between the foot and the big toe, as part of edging. It also allows the arch to move enough to function normally. This design thereby allows effective edging motions of the foot and avoids unnecessary immobilization of the foot.

In other embodiments intended for classic skiing, the boot has a forefoot which bends only in the vertical direction, but easily in the full range of motion of the ball of the foot. In these embodiments, the mid-foot of the sole of the boot twists, but less than in other embodiments intended for skating, so as to better support the flat ski when kicking. The twisting action is greater in some embodiments intended for skate skiing than in various embodiments intended for classic skiing, because a skate skier typically spends more time on edge and uses a steeper edge angle for longer times, such as when skating uphill, as compared to a classic skier.

Combi boots in various embodiments have maximal ball of foot flex and maximal twist, so as to allow foot movements of both types. In various of these embodiments there is no lateral flexion in the sole at all, ensuring that the boot will land back on the binding during the recovery phase of the stroke. In certain embodiments these features of the boot's sole are accomplished with existing carbon fiber technology. In some embodiments the combination of twisting and lateral stiffness in the mid-foot area is assisted by a simple cylinder and tube hinge embedded into that area of the boot. The ability for the ball of the foot to spring back to being flat is assisted in various embodiments by tiny elastic cords or by spring cables or some other stretchy materials which extend along the length of the boot, between the midsole and the outer sole, and which are accessible in case it becomes necessary to replace them. Use of such an elastic cord, spring cable, or such like is particularly useful in embodiments wherein the sole is made from plastic, without including carbon fiber.

Various skate and combi embodiments include an adjustable cuff which allows full plantar flexion, full normal range of motion of dorsiflexion, and a limited, controlled amount of eversion and inversion at the ankle, which is adjustable by the skier. The lateral ankle movement allowed by some of these embodiments is from very slight inversion to full eversion, since those are the normal foot movements used in Nordic skiing. The skier can adjust the sliding mechanism of the cuff in some of these embodiments to adjust the maximum ranges of inversion and eversion.

In certain embodiments, there are adjustments on one or both sides of the ankle, so as to allow the skier to adjust the boot so that its movements follow the movements of the foot, and so that the center of the joint is the axis of motion. The cuff in certain embodiments allows effective foot eversion when the foot is in full plantar flexion (when the leg is in full extension). Some embodiments include removable cuffs, while other embodiments do not include cuffs, for example for classic boots, and for skating and combi boots for use on snow by skiers who want ultra lightness and maximal range of movement and who have strong feet and ankles. For skiers wanting ankle support and for roller skiing, the cuff in various embodiments provides support, while allowing freedom of movement for all of the ankle movements which are involved in optimal skating technique.

Embodiments of the present invention include an inner layer of the boot which encompasses the entire foot and conforms to the shape of the foot. In some of these embodiments the inner layer is made of fabric, with a custom fit heel and forefoot. In some high-top skate and combi boot embodiments, this inner layer extends past the ankle and can be laced up like a hiking boot if desired. In some of these embodiments the inner layer include hook-type eyelets similar to eyelets which are used for some hiking boot, thereby enabling the inner layer to be laced above the ankle for added ankle support.

In various embodiments the next layer outside of the inner layer is made up of the two straps, one at the heel and the other at the ball of the foot. In some embodiments, the hard plastic heel area and the cuff discussed above make up a third layer, which is sewn to the second layer around the heel, and is its own free-moving layer at the cuff.

Various embodiments further include an overboot for added waterproofing and insulation for winter use. In summer, for roller skiing, some of these embodiments can be used without the overboot.

It should be noted that some embodiments of the present invention include some of these features and not others, while other embodiments include all of the features described above.

One general aspect of the present invention is a Nordic ski boot having a sole, the Nordic ski boot including a customizable ball attachment mechanism capable of maintaining firm and customizable contact between the ball of a user's foot and a ball region of the sole and a customizable heel attachment mechanism capable of maintaining firm and customizable contact of a user's heel with a heel region of the sole.

In embodiments, the customizable ball attachment mechanism includes a ball strap extending across the ball of the user's foot, the ball strap being adjustable in tightness. In some of these embodiments the ball strap is about approximately one inch wide. In other of these embodiments the ball strap is attached to custom locations on the boot according to the user's anatomy, including a location of the ball of the user's foot. In still other of these embodiments the ball strap is sewn to the boot. And in yet other of these embodiments locations of attachment of the ball strap to the boot are adjustable by the user.

In some embodiments the customizable heel attachment mechanism includes a moldable material located in the heel region of the boot. In other embodiments the customizable heel attachment mechanism includes a concave shaping of the sole of the boot in its interior heel region, so as to fit the user's heel. In various embodiments the customizable heel attachment mechanism includes an inflatable mechanism. And in certain embodiments the customizable heel attachment mechanism includes a strap which extends from a bottom rear location on one side of the heel, over a proximal top of the foot, and down to a bottom rear location on the other side of the heel, thereby helping to maintain the user's heel securely positioned in the boot.

In various embodiments the boot allows the big toe to go straight forward from the foot. In some embodiments a forefoot of the boot, including a toe box region, is custom moldable. In other embodiments a toe box region of the boot is not a source of steering precision.

In certain embodiments a lower surface of a sole of the boot includes a pattern in a heel region and in a forefoot region, the pattern being compatible with an existing binding system, the pattern being absent in a region between the heel region and the forefoot region. In some embodiments a lower surface of a sole of the boot includes a pattern substantially over its entirety, the pattern being compatible with an existing binding system.

In various embodiments the sole can be flexed by a flexing force in a vertical direction only so far as to accommodate a portion of a toe extension of the user's toes, the sole being configured so as to spring energetically back to a flat configuration when the flexing force is removed. In some embodiments the sole can be flexed by a flexing force in a vertical direction over a full extension of the user's toes, the sole being configured so as to spring energetically back to a flat configuration when the flexing force is removed. In other embodiments the sole can be twisted by a twisting force in a region between a front-of-the-heel region and a ball-of-the-foot region, the sole being configured so as to spring energetically back to a flat configuration when the twisting force is removed.

In certain embodiments the sole allows a user to do foot eversion at the mid-foot, in the joints between the tarsal bones and between the tarsals and metatarsals, the sole further allowing the user to weight the joint between the foot and the big toe, as part of ski edging, and the sole further allowing the user's arch to move enough to function normally.

In embodiments the boot includes a forefoot region which is bendable only in a vertical direction, the forefront region being easily bendable over a full range of motion of the ball of the user's foot. In various embodiments the sole includes carbon fiber.

Various embodiments further include a cylinder and tube hinge embedded in a mid-foot region of the boot, the cylinder and tube hinge being configured to enhance a twistability and lateral stiffness in a mid-foot region of the boot. Other embodiments further include a groove along both sides of the boot and surrounding the heel of the boot, the groove being configured to retain an elastic cord which is attachable to a ski binding, the elastic cord being thereby configured to assist in returning the boot to a flat configuration against a ski when the boot is flexed about the ball of the user's foot and the heel of the boot is lifted from the ski.

Certain embodiments further include a cuff configured with a range-limiting mechanism that allows full plantar flexion and a determined range of motion of dorsiflexion, while limiting amounts of foot eversion and inversion to cuff-limited ranges. In some of these embodiments the range-limiting mechanism is adjustable by the user. In other of these embodiments the cuff allows full plantar flexion and full dorsiflexion, even beyond a normal range of motion. In still other of these embodiments the range-limiting mechanism includes adjustments on both sides of the cuff. In yet other of these embodiments the cuff is removable from the boot. In still other of these embodiments the range-limiting mechanism of the cuff includes a protrusion on a first portion of the cuff, that is impacted by a second portion of the cuff when the cuff reaches an end of its range. And in some of these embodiments the protrusion is removable.

Certain embodiments further include an over-boot that is able to encompass at least a portion of the boot and that provides enhanced water penetration resistance and enhanced thermal insulation.

In various embodiments the boot includes an inner layer configured to encompass the foot of a user. In some embodiments only minimal force is required to flex the boot about the ball of the user's foot. In other embodiments the boot is cut so as not to extend above the ankle of a user, the ankle being thereby free to move without hindrance by the boot.

In certain embodiments the boot is configured to bend about a forward bending region surrounding the ball of the user's foot, the forward bending region having a bending area on a big toe side which is larger than a bending area on a little toe side, the forward bending region being thereby configured to bend in a pattern that corresponds with an anatomical bending movement of the foot, the forward bending region being thereby configured to maintain the foot in alignment with an attached ski and binding as the ball of the foot bends.

Various embodiments further includes a plurality of extendible cords contained in tunnels within the between a mi-region of the sole and an outer region of the sole, the extendible cords tending to energetically retract to their non-extended lengths when released, the extendible cords being configured to help the boot spring back to being flat after the ball of the foot is bent. In some of these embodiments the extendible cords are removable from and replaceable in the tunnels.

In certain embodiments a bottom surface of the heel region includes a feature that is compatible with a boot binding system, the feature preventing lateral movement of the heel region relative to the binding when the boot is placed flat against the binding, while allowing freedom to lift the heel region upward and away from the binding.

In various embodiments the boot is able to twist in a mid-foot region. In some embodiments the boot is able to twist only in a mid-foot region. In other embodiments, the boot allows eversion of a forefoot of a user relative to a hindfoot of the user, but does not allow inversion of the forefoot of the user relative to the hindfoot of the user. And in certain embodiments the boot can be flexed in a region surrounding the ball of a user's foot.

Another general aspect of the present invention is a Nordic ski boot including a cuff configured with a range-limiting mechanism that allows full plantar flexion of the boot and a determined range of motion of dorsiflexion of the boot, while limiting amounts of foot eversion and inversion to cuff-limited ranges.

In some embodiments the range-limiting mechanism is adjustable by the user. In various embodiments the cuff allows full plantar flexion and full dorsiflexion, even beyond a normal range of motion. In certain embodiments the range-limiting mechanism includes adjustments on both sides of the cuff. In embodiments, the cuff is removable from the boot.

In various embodiments the range-limiting mechanism of the cuff includes a protrusion on a first portion of the cuff, that is impacted by a second portion of the cuff when the cuff reaches an end of its range. And in some of these embodiments the protrusion is removable.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

With reference to FIGS. 2A through 2F, the present invention is a Nordic boot which enables precise control of a ski while providing a comfortable fit and controlled flexibility for natural movement of the ankle and lower leg during pushing and edging, thereby significantly reducing the likelihood of a skier developing compartment syndrome. Some embodiments are appropriate for skiing on snow, while other embodiments are configured for roller skiing. The invention provides secure attachment of the foot to the boot at the heel and at the ball of the foot, while providing limited degrees of flexing and twisting elsewhere along the length of the foot.

In some embodiments, only minimal force is required to flex the boot in the region of the ball of the foot. The stiffness of many prior art boots in this region isn't useful if the user's feet are strong, and stiffness in this region can be problematic for the movements of classic skiing.

Figure 1C:
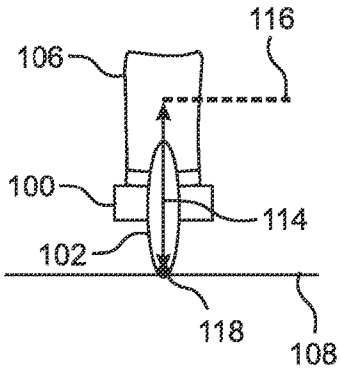
FIG. 1C is a rear view illustrating the location of a skiers foot during roller ski skating.
Figure 1D:
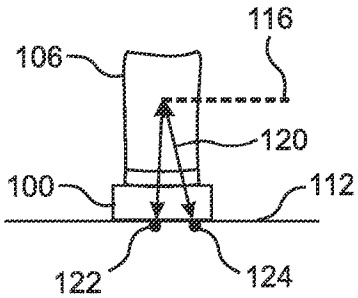
FIG. 1D is a rear view illustrating the location of a skiers foot during snow ski skating.
Figure 1A:
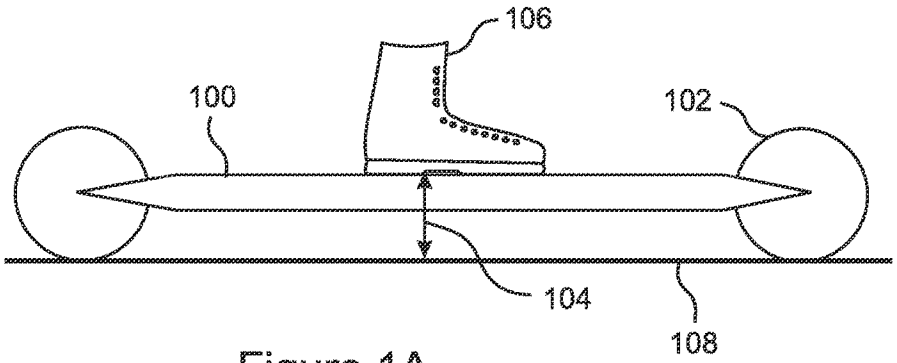
FIG. 1A is a side view illustrating the location of a skiers foot during roller ski skating.
Figure 1B:
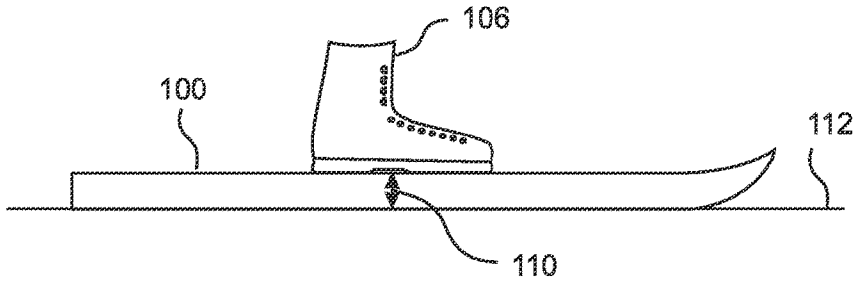
FIG. 1B is a side view illustrating the location of a skiers foot during snow ski skating.
Figure 2A:
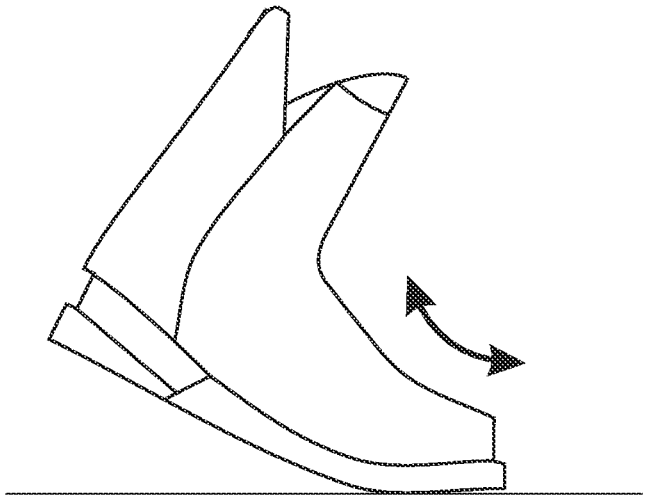
FIG. 2A is a side view of a boot of the present invention illustrating flexing of the toe region.

FIG. 2A shows that the ball of the foot bends in toe extension. The ball of the foot bends as far as the human toes can bend, for classical and "combi" boots, because classical technique sometimes involves full toe extension. This is about 80 degrees. For skate boots, the amount of bend is about three quarters that of classical. The soles in embodiments of the present invention are designed to bend in the anatomically correct place, i.e. where the foot bends.

Figure 2B:
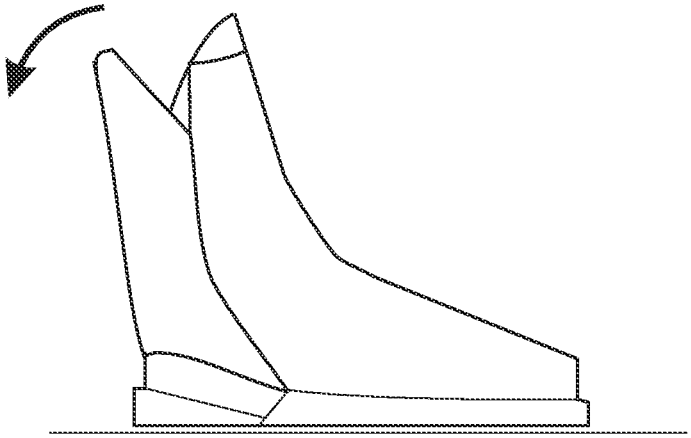
FIG. 2B is a side view of the boot of FIG. 1A illustrating plantar flexing.
Figure 2C:
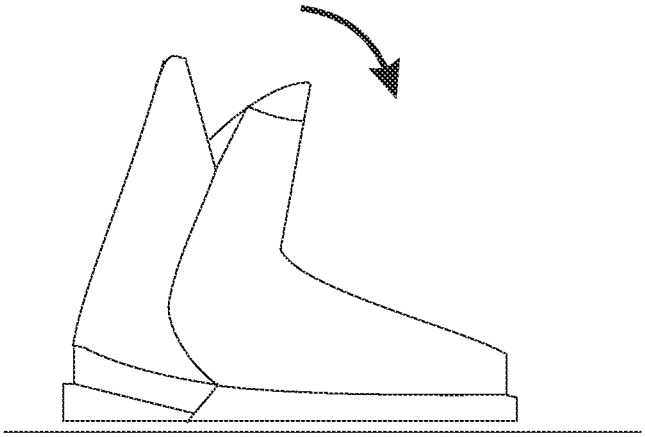
FIG. 2C is a side view of the boot of FIG. 1A illustrating dorsiflexion.

FIG. 2B shows a boot of an embodiment moving at the ankle cuff in plantar flexion and FIG. 2C illustrates dorsiflexion. In some regular skate and combi embodiments which are designed for skiers wanting ankle support and for roller skiing, the ankle cuff allows a full range of motion of the ankle in plantar flexion and the entire normal range of motion in dorsiflexion. The cuff in some of these embodiments prevents bending beyond the normal range of motion of dorsiflexion. Note that in some embodiments intended for classical skiing, and in some skate and combi embodiments intended for use only on snow by the most advanced skiers, the boot is low-cut and has no cuff, so that the skier's ankle can move freely.

Figure 2E:
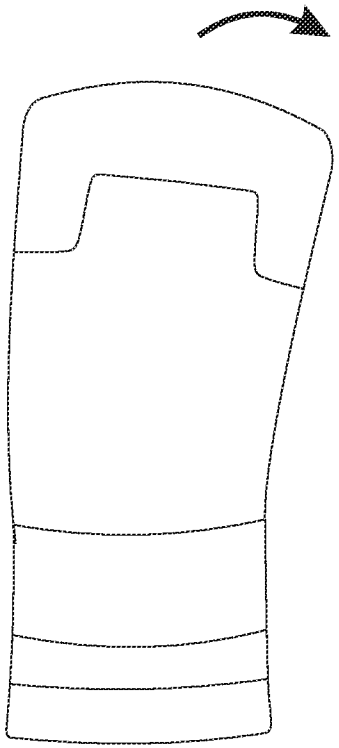
FIG. 2E is a rear view of the boot of FIG. 1A illustrating ankle inversion.
Figure 2D:
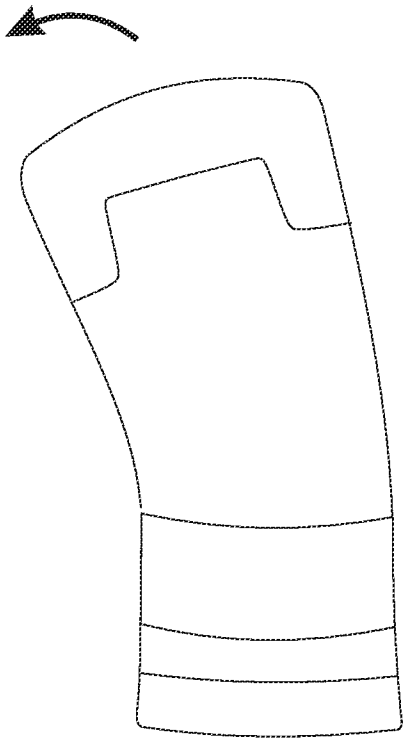
FIG. 2D is a rear view of the boot of FIG. 1A illustrating ankle eversion.

FIG. 2D shows how some skate and combi embodiments intended for use by skiers wanting ankle support and for roller skiing include an adjustable cuff which allows the ankle to move in the range of motion chosen by the skier, which can be up to as much eversion as the ankle will allow, and FIG. 2E illustrates how some embodiments allow a slight amount of inversion. The cuff in the embodiment of FIG. 2D and FIG. 2E allows the skier to adjust this range of inversion/eversion motion of the boot between 0 and 2 degrees for inversion and between 0 and about 20 degrees for eversion. The skier can adjust the cuff to prevent any inversion or eversion (both adjusted at 0), or to allow the full 2 degrees to about 20 degrees, or to allow any range of motion in between. The human hindfoot is capable of more than 2 degrees of inversion, but this degree of inversion is not used in skiing, and it is important to support the ankle and prevent excess inversion so as to prevent sprains. The cuff in the embodiment of FIGS. 2D and 2E is adjustable on both sides, so that the skier can ensure that the axis of movement of the boot matches the axis of movement of the ankle joint. Note that in some other low-cut embodiments, there is no cuff, and the skier has unlimited mobility in inversion/eversion.

Figure 2F:
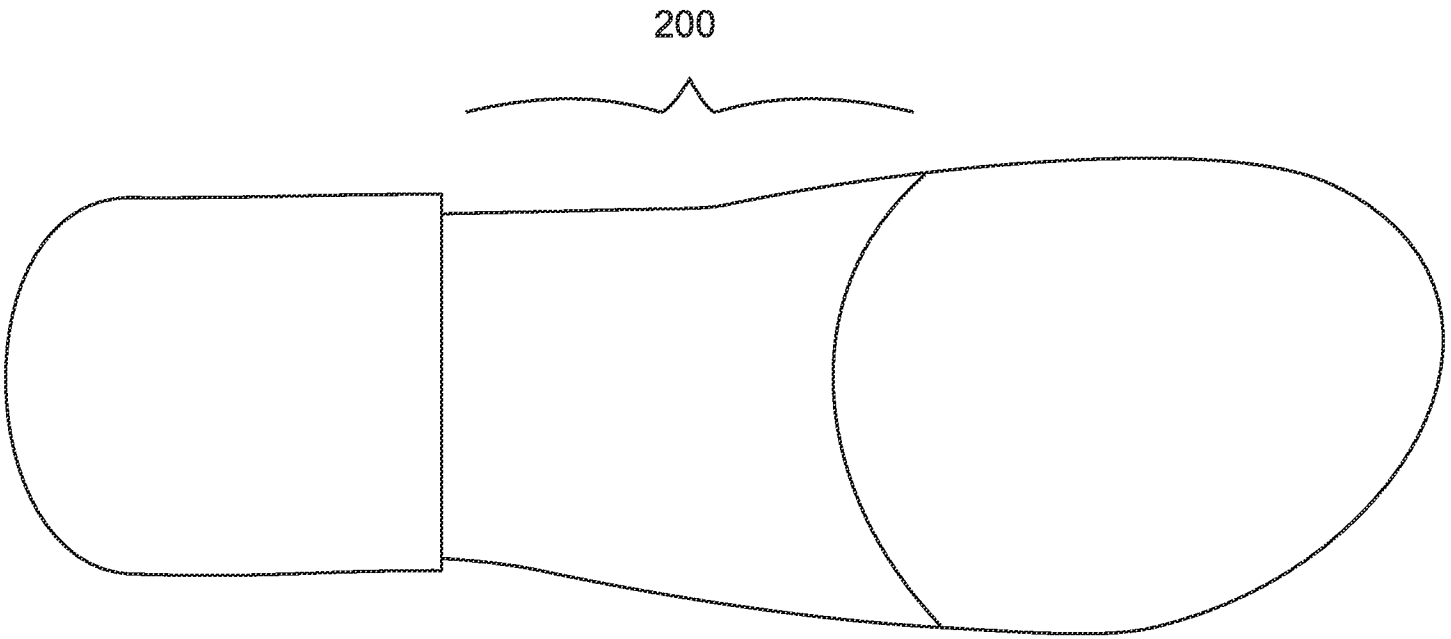
FIG. 2F is a bottom view of the boot of FIG. 1A illustrating a twisting region between the front of the heel and the ball of the foot.

FIG. 2F shows the area 200 of the sole of the boot that can twist in an embodiment of the invention. It is between the front of the heel and the back of the ball of the foot. This is where the bones of the foot that perform this motion are located. Some embodiments intended for skate skiing can twist quite a bit, for optimal foot eversion in edging during skating. Other embodiments for classic skiing allow less twisting, so as to help the skier maintain a flat ski most of the time, while allowing some twisting for edging during cornering. In some embodiments for skate skiing, the twisting range is between 20 and 25 degrees, and for some embodiments intended for classic skiing, the twisting range is between 10 and 15 degrees. In some embodiments, this twisting action is just into eversion of the forefoot relative to the hindfoot, and not into inversion.

Figure 2G:
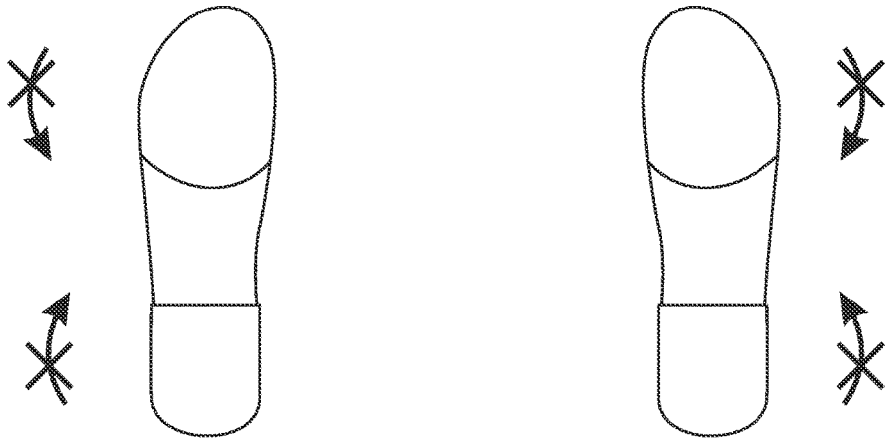
FIG. 2G is a bottom view of a pair of the boots of FIG. 1A illustrating that lateral flexion is prevented.
Figure 2H:
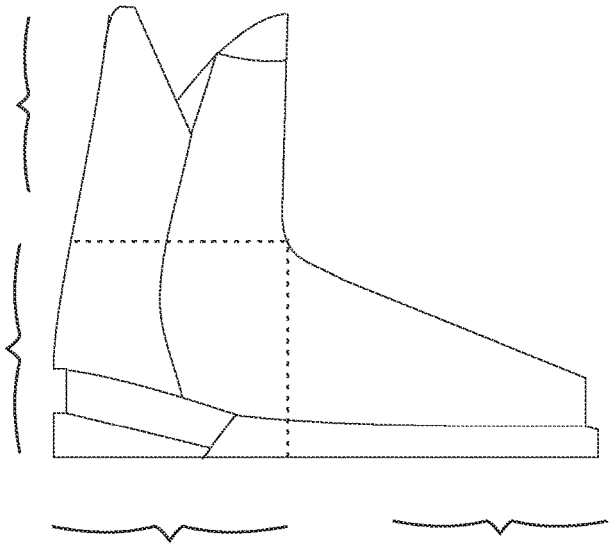
FIG. 2H is a side view of the boot of FIG. 1A illustrating regions of the boot that are designed not to move and where support is provided.
Figure 2I:
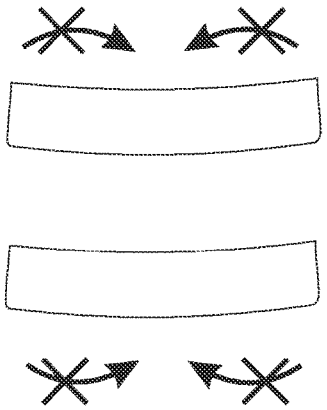
FIG. 2I is a rear view of the soles of a pair of the boots of FIG. 1A, illustrating that the sole will not become concave or convex.

FIGS. 2G through 2I illustrate stiffness properties of boots in various embodiments.

FIG. 2G illustrates an embodiment in which there is no lateral flexion of the sole of the boot. This is very important so that when the foot goes back down onto the ski and always meets the binding precisely. There are x's through the arrows that show what lateral flexion would be if there were any. However, in the embodiment of FIG. 2G there is essentially none.

FIG. 2H shows sections of a boot of the present invention that are stiff, and that give support to the foot and leg, and provide stable supports for the parts of the boot that facilitate movement. These are the cuff, the sides of the heel area, the bottom of the heel, and the area of the sole that is in front of the ball of the foot.

FIG. 2I shows a rear view of the sole of a boot of the present invention and shows that the cross section of the boot does not become more convex or more concave due to forces created while skiing. This is important so the foot has a consistent platform on which to rest with a consistent fit to the foot, so that a molded foot bed or orthotic will fit the foot consistently while skiing.

Figure 3:
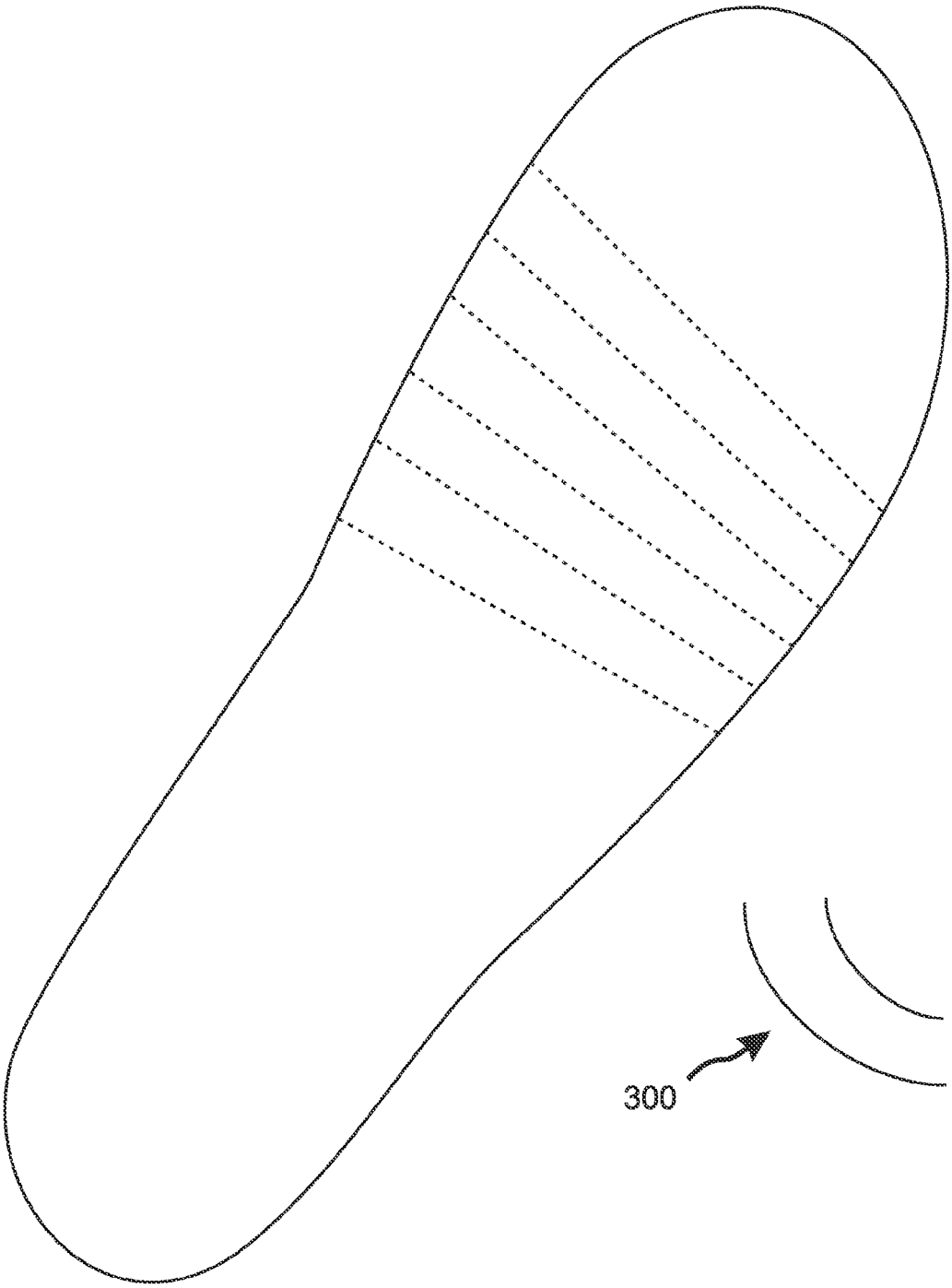
FIG. 3 is a bottom view of a boot showing where the ball of the foot bends in various embodiments, and how the shape of the bending area of the boot in these embodiments follows the anatomy of the foot and yet the boot has a consistent angle of bend across the ball of the foot, so the foot bends in straight forward alignment.

FIG. 3 shows where the sole of the boot bends in an embodiment to allow toe extension (bending at the ball of the foot). The sole bends in a pattern that matches where the foot anatomically bends. Notice that area is larger on the big toe side of the foot than on the little toe side of the foot. This is because the foot works that way. The arc of the bend on the big toe side of the boot is a little gentler than the arc of the bend on the little toe side, so that in effect, the ball of the foot bends the same number of degrees all the way across. This keeps the foot in straight-ahead alignment as the ball of the foot bends, and keeps the boot in good alignment for meeting the binding, while also honoring the real shape of the movement of the foot. In embodiments intended for skate skiing, the sole springs back to being flat, as soon as the force bending it is removed, such as when the foot is lifted off the snow.

The two curved lines 300 in the bottom right hand corner of FIG. 3 show how a shorter line that bends more sharply and a longer line that bends more gently can both bend the same number of degrees. This illustrates the basic geometric principle behind why it works in various embodiments to have a gradual progression of lengths of the boot that bend and of bending radii. The shorter, more sharply curved line can represent what happens at the ball of the foot on the little toe side, and the longer, more gently curved line can represent what happens at the ball of the foot on the big toe side. The big toe side of the boot has a longer area of bend and a more gradual bend, and the little toe side of the boot has a shorter area of bend and a sharper bend, and they both come out to the same degree of bend at the same time, with an overall effect of supporting the foot in a straight forward bend.

FIG. 3 is also based on a good foot proportion for the narrowest of the shapes of two or more lasts.

Figure 4:
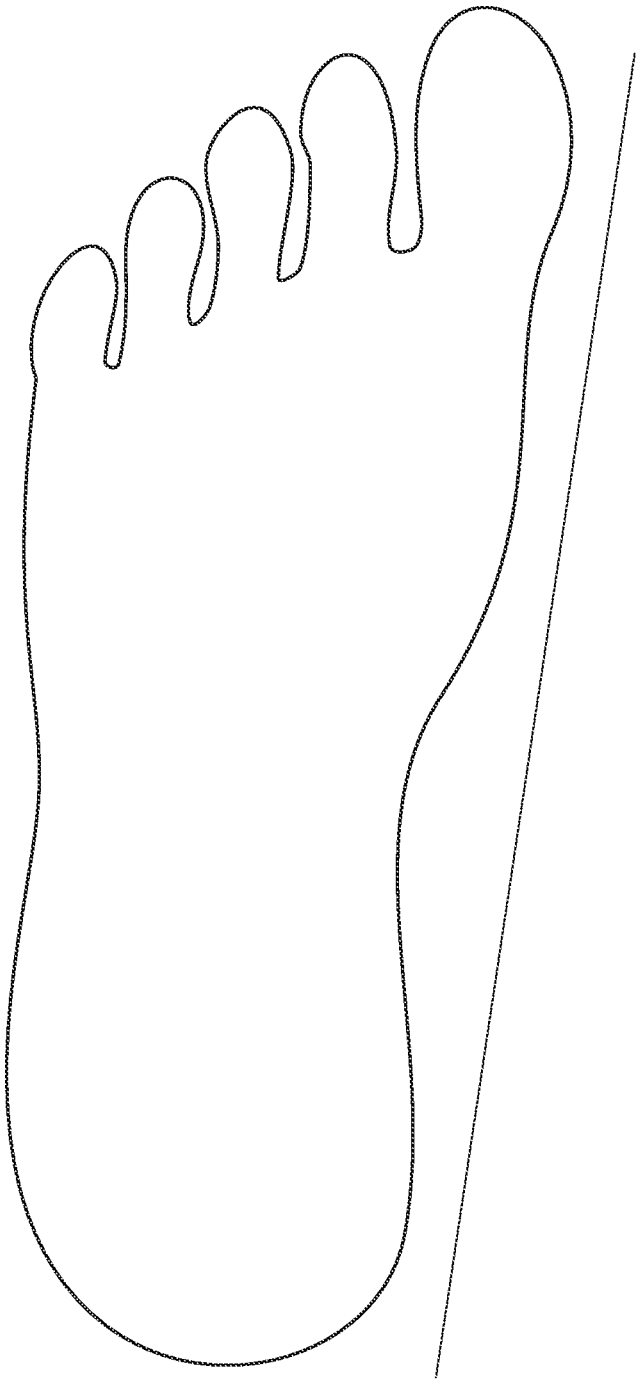
FIG. 4 illustrates an important aspect of the geometry of the last shape in embodiments of the present invention, in that the boot does not push the big toe in toward the midline of the foot, but lets it go straight forward from the foot.

FIG. 4 shows the concept of the fit of the boot in certain embodiments which allow the big toe to go straight forward from the foot without pushing it toward the midline of the foot. It is helpful for edge control and for basic health of the foot, including bunion prevention, for the big toe to be allowed to go straight forward from the foot.

Figure 5:
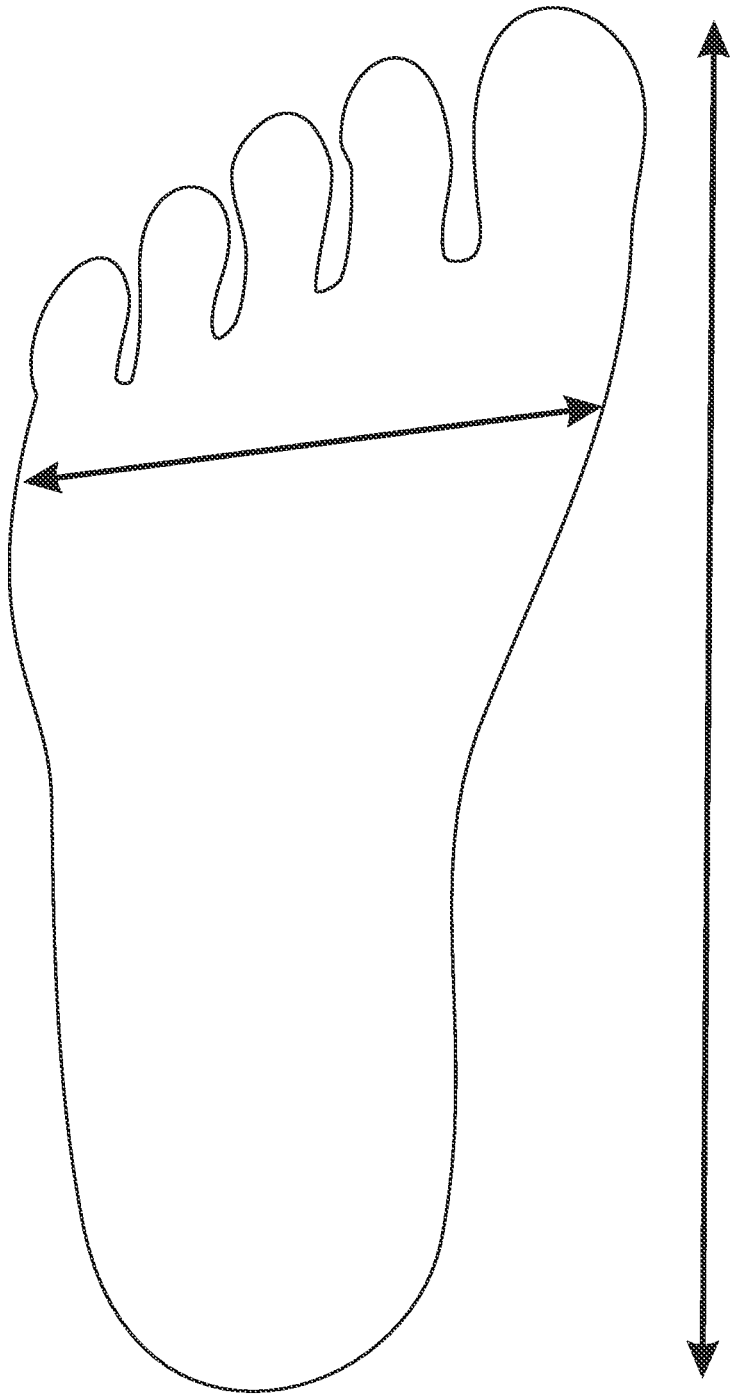
FIG. 5 shows a common foot proportion which is not fit properly by prior art ski boot models, the foot being wider that what prior art boots can fit.

FIG. 5 helps to illustrate the need for at least two different shaped lasts for each size of boot in various embodiments. The outline shows a common foot proportion for wider feet, which typically are not properly fit by Nordic boots of the prior art. People with this type of foot are either in a lot of pain when they ski, or they don't ski at all. This is the wider last shape. There is also a narrow last shape, which is more similar to the shape of the embodiment of FIG. 3.

Figure 6B:
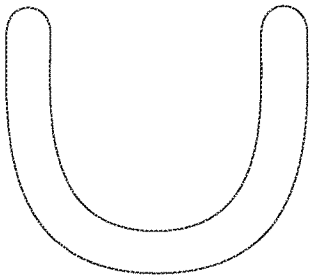
FIG. 6B is a top view of the custom heel of the embodiment of FIG. 6A.
Figure 6A:
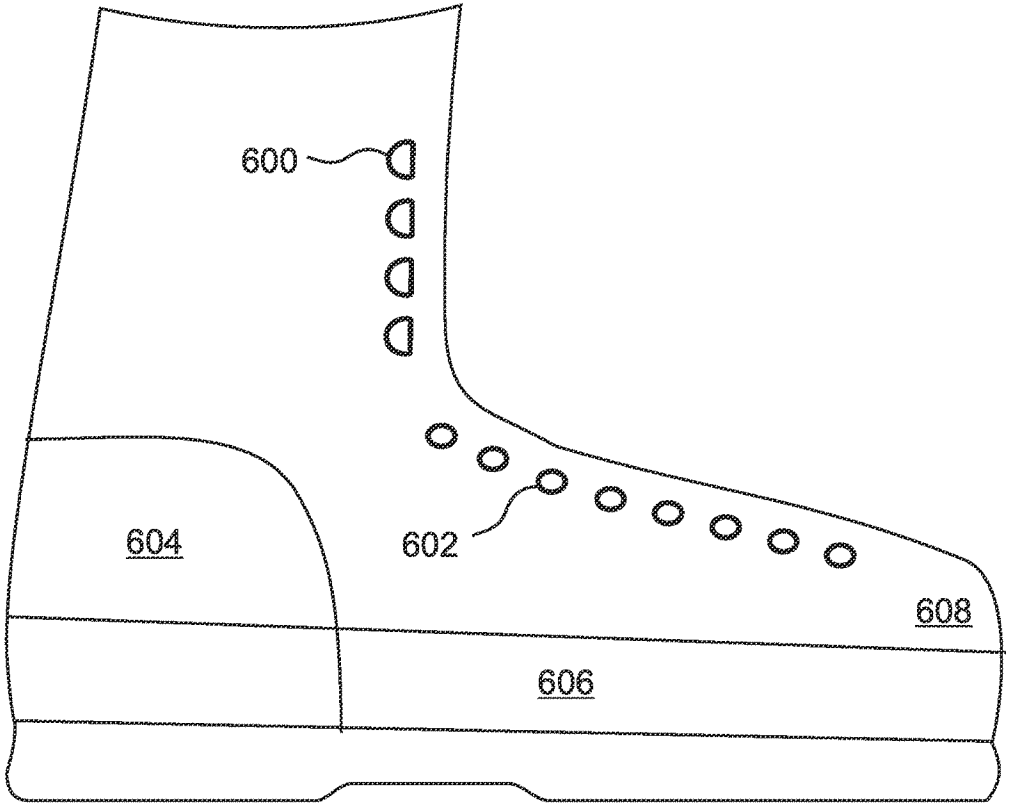
FIG. 6A is a side view of an embodiment showing the inner layer of the upper section of the embodiment.

FIG. 6A shows the inner layer of the upper section of the boot in an embodiment. This layer includes custom fitting fabric in the toe box 608, and a tough waterproof layer in a region above the sole 606 and extending completely around the boot which is also custom moldable. This layer further includes a custom fitting heel 604. In some embodiments the heel is fitted by an inflatable mechanism similar to an air cast. In other embodiments, the heel is fitted by using a heat moldable material such as is used for the entire interior of many Telemark boots. And in still other embodiments the heel is fitted by another fitting mechanism known in the art. FIG. 6 further illustrates hooks 600 extending up the ankle which enable higher lacing for added support, in addition to loops 602 provided for laces.

Note that various embodiments of the invention include all of the features illustrated in FIG. 6A, while other embodiments include only some of these features.

FIG. 6B is a top view of the shape of the custom-fit heel material. This is a U shape, going along the entire right side of the heel, around the back of the heel, and along the entire left side of the heel. The custom fit heel in the embodiment of FIG. 6B gives the heel a fit which is snug and precise but also comfortable, formed by a soft but perfectly-fit material. In some embodiments the fit of the heel in FIG. 6B is further customized by an indentation in the bottom of the boot which is similar to the shape of the bottom of the heel, as shown in FIGS. 9A and 9B, and some embodiments further include an orthotic or molded foot bed which precisely fits the bottom of the heel of the skier. Embodiments include any of these features either separately or in any possible combination. Further precision is obtained in some embodiments by including the strap feature which is illustrated in FIGS. 7 and 8.

Figure 7:
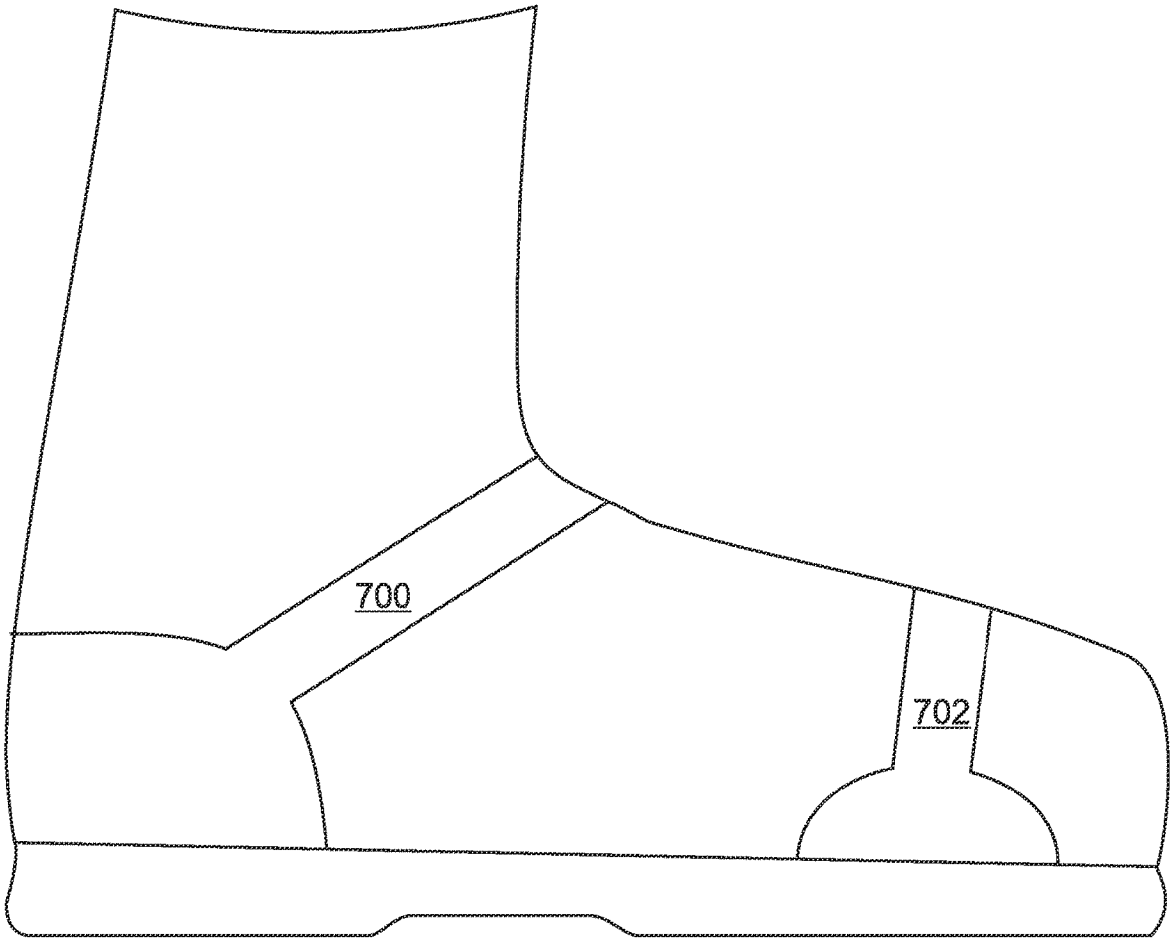
FIG. 7 is a side view illustrating the next outer layer of the embodiment of FIG. 6.

FIG. 7 shows the second layer of the embodiment of FIGS. 6A and 6B which immediately surrounds the inner layer which is illustrated in FIGS. 6A and 6B. This second layer includes a toe strap 702 and a heel strap 700.

Figure 8:
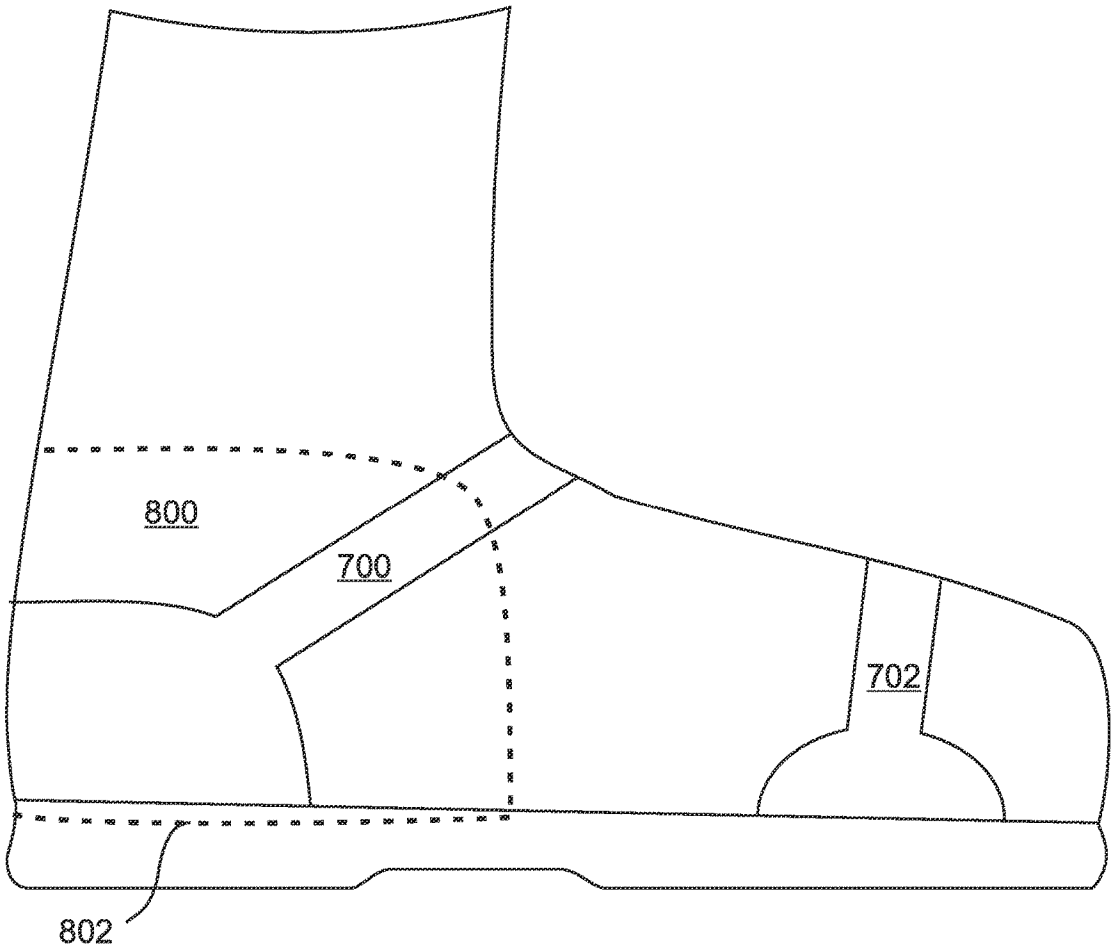
FIG. 8 is a side view illustrating design details of the two precise points of contact of an embodiment for precise control of the ski through foot movement, without immobilizing or compressing the foot.
Figure 9A:
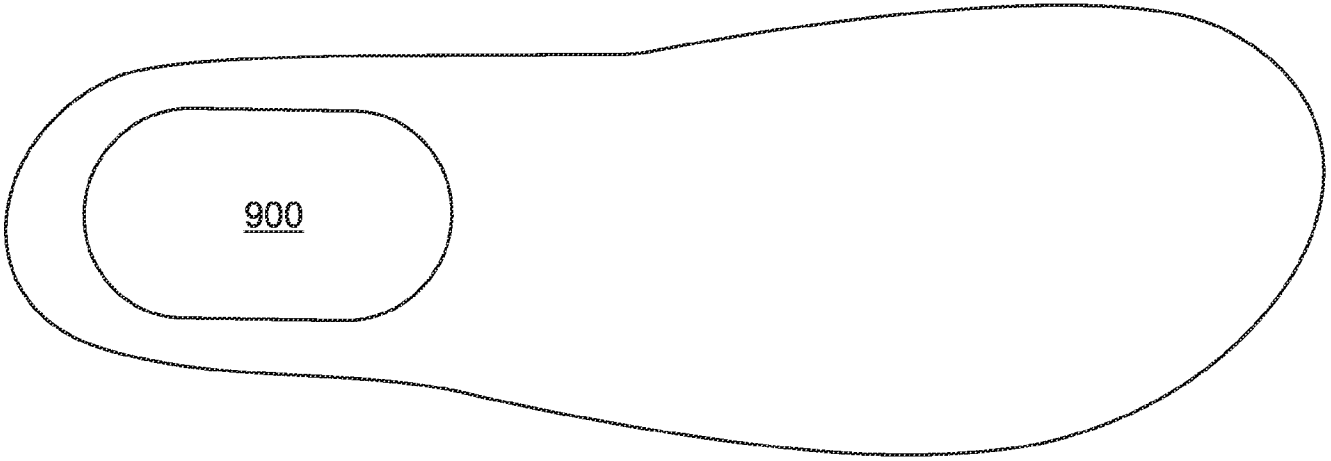
FIG. 9A is a top view of the interior of the bottom of an embodiment where the bottom of the boot includes a concave indentation to help the heel area to have a precise fit.
Figure 9B:
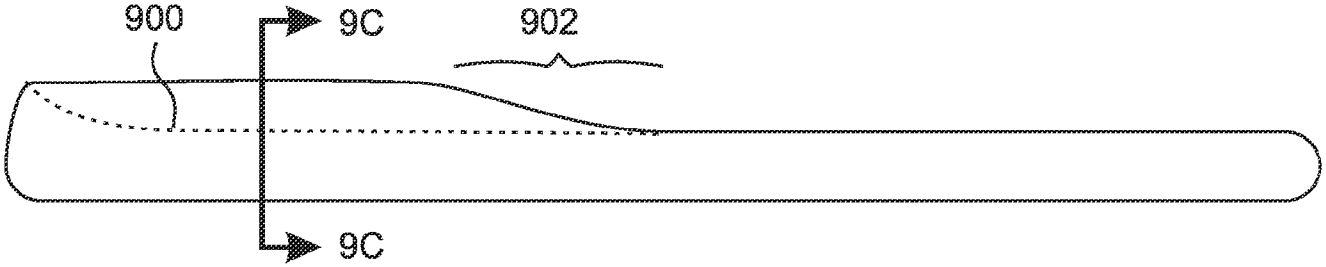
FIG. 9B is a side view of the embodiment of FIG. 9A.

FIG. 8 illustrates the two precise points of contact of the invention and how they are achieved and function in various embodiments of the boot. This is one of the key concepts of how this present invention achieves precise control of the ski without hurting the foot. The embodiment of FIG. 8 includes a strap 702 over the ball of the foot which in various embodiments is made of rock climbing webbing or of some other very strong material. In some embodiments, the strap is custom placed in a fixed location, or its placement can be adjusted by the skier. The tightness of the strap can be adjusted after the skier has laced up the inner layer of the boot which is illustrated in FIGS. 6A and 6B. When the strap 702 over the ball of the foot is tightened, it gives great precision to the fit of the front of the boot, and therefore contributes greatly to the control of the ski by the foot.

The precise fit of the heel is achieved in various embodiments through one or several or all of the following features: a custom molded heel area 800 (as discussed with regard to FIGS. 6A and 6B above), a concave area 802 of the sole of the boot and the insole which matches the shape of the bottom of the heel, and an adjustable-tension strap 700 which helps to secure the heel of the foot in the heel of the boot. In various embodiments these straps can be adjusted as to their tightness, via any method known in the art, such as a sliding buckle mechanism similar to what is used on backpacks and bike helmets, a ratchet device, a hook-and-loop closure, and any other device which is known in the art and which is able to withstand the forces of skiing without unintentionally releasing. Some embodiments include a continuously adjustable mechanism, so that the skier can adjust it with precision.

Due to the precision and fit of these two points of contact, no further fixed points of contact are required so as to achieve extremely good overall control of the ski by the foot.

Figure 9C:
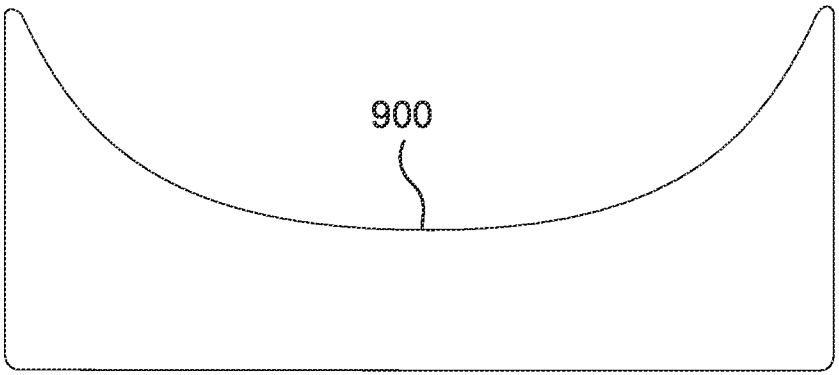
FIG. 9C is a rear cross-sectional view of the embodiment of FIGS. 9A and 9B.

FIG. 9A shows a top view of the bottom of the boot in an embodiment which includes a concave area 900 for the skier's heel to rest in. The orthotic or footbed in this embodiment is made to specifically fit the individual's heel in this way, and gives an even more precise fit. FIG. 9B is a side view that shows how this concave area 900 of the heel gradually blends 902 into being a flat sole further forward. The sole is thicker in the heel area, so that the user's foot is horizontal relative to gravity. FIG. 9C is a rear cross sectional view of the embodiment of FIGS. 9A and 9B.

Figure 10:
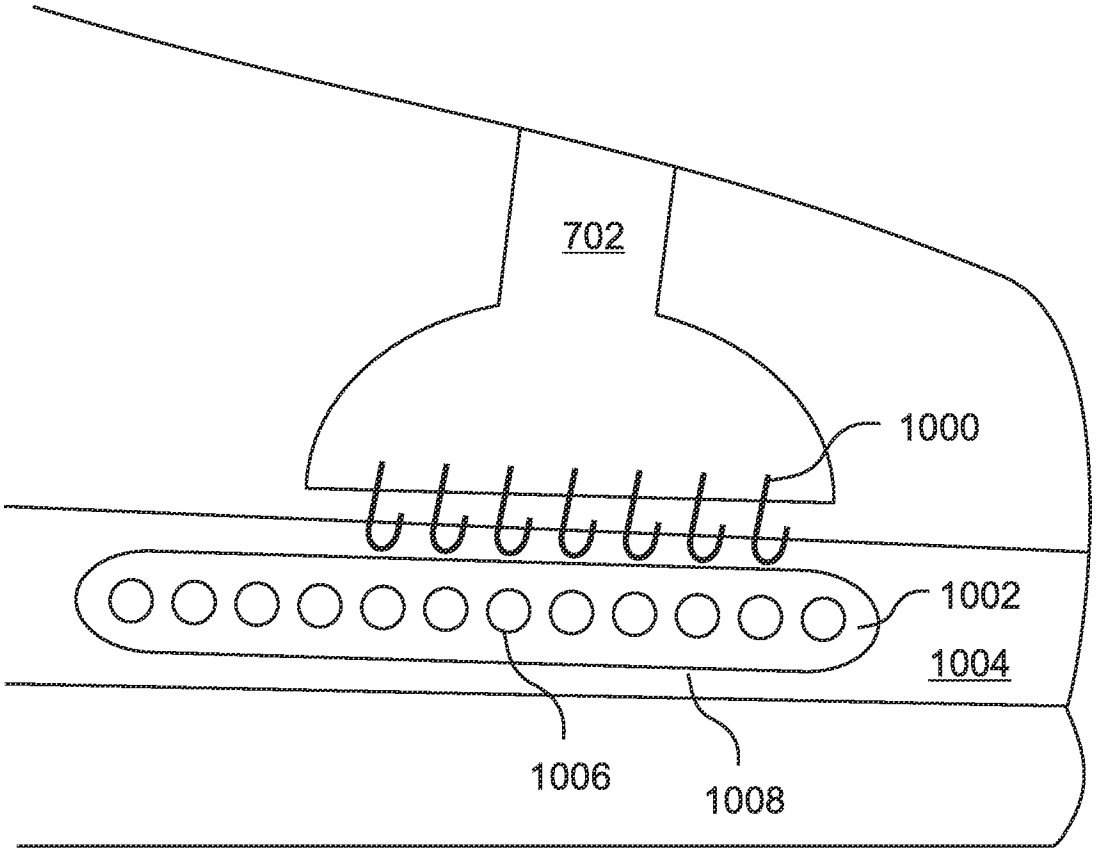
FIG. 10 is a side view of the front portion of an embodiment that includes a strap at the ball of the foot that can be adjusted for exact placement fore and aft on the boot.

FIG. 10 shows a mechanism included in some embodiments which allows a skier to adjust the location of the strap 702 over the ball of the foot toward the front or the back of the foot. The mechanism in this embodiment includes a very tough piece of fabric 1002 which is penetrated by a plurality of reinforced holes 1006, the holes being reinforced by metal grommets in some embodiments. The tough fabric is sewn just around its outside edge 1008. The strap 702 is attached via a plurality of small hooks 1000 that fit snugly into the reinforced holes 1006. There are more holes 1006 than hooks 1000, so the strap 702 can be located in incremental positions forward and aft on the foot.

Embodiments in which the strap 702 over the ball of the foot is permanently installed by sewing it in a fixed, custom location in a shop or in a factory, after identifying where the ball of the individual skier's foot is located inside the boot, may provide enhanced performance, because such embodiments can be fit more precisely to the skier, and may also provide enhanced durability, lighter weight, and simpler usage. However, embodiments which include adjustable mechanisms such as the hook 1000 and hole 1006 mechanism of FIG. 10 may have the advantage of enabling a skier to experiment with the positioning of the strap, and also to remove the strap altogether.

Figure 11:
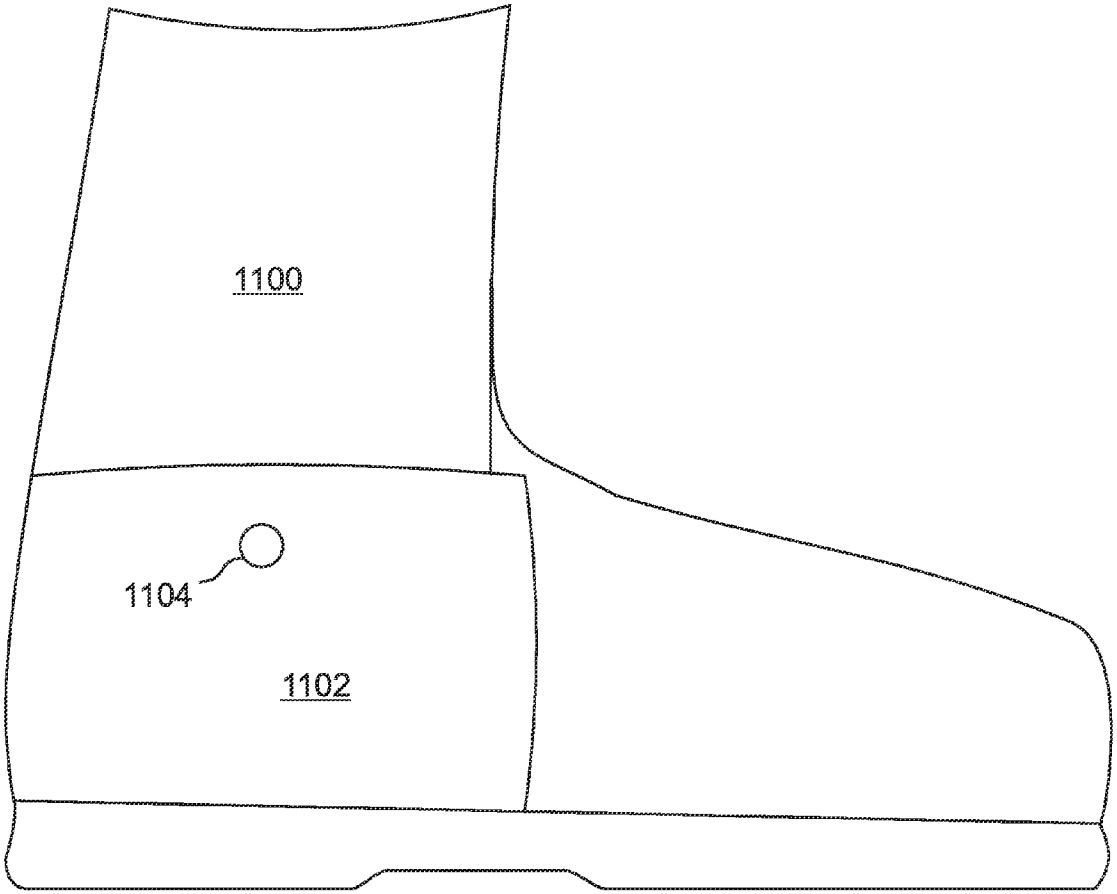
FIG. 11 is a side view of an embodiment illustrating the next most superficial layer of the invention, which includes a cuff.

FIG. 11 shows the third layer of an embodiment of the invention, which is a cuff 1100, a rigid outer layer of heel 1102, and a hinge 1104 in between the two. This layer is illustrated in more detail in the next few drawings. It is a continuation of a series of layers which also includes FIGS. 6A, 6B, 7, 14A and 14B. This third layer forms an exoskeleton which protects and supports the joints of the ankle and hindfoot. It provides a rigid outer shell around the sides of the heel and a cuff around the bottom of the lower let, with a joint that allows plantar flexion, dorsiflexion, and adjustable inversion and eversion.

Figure 12:
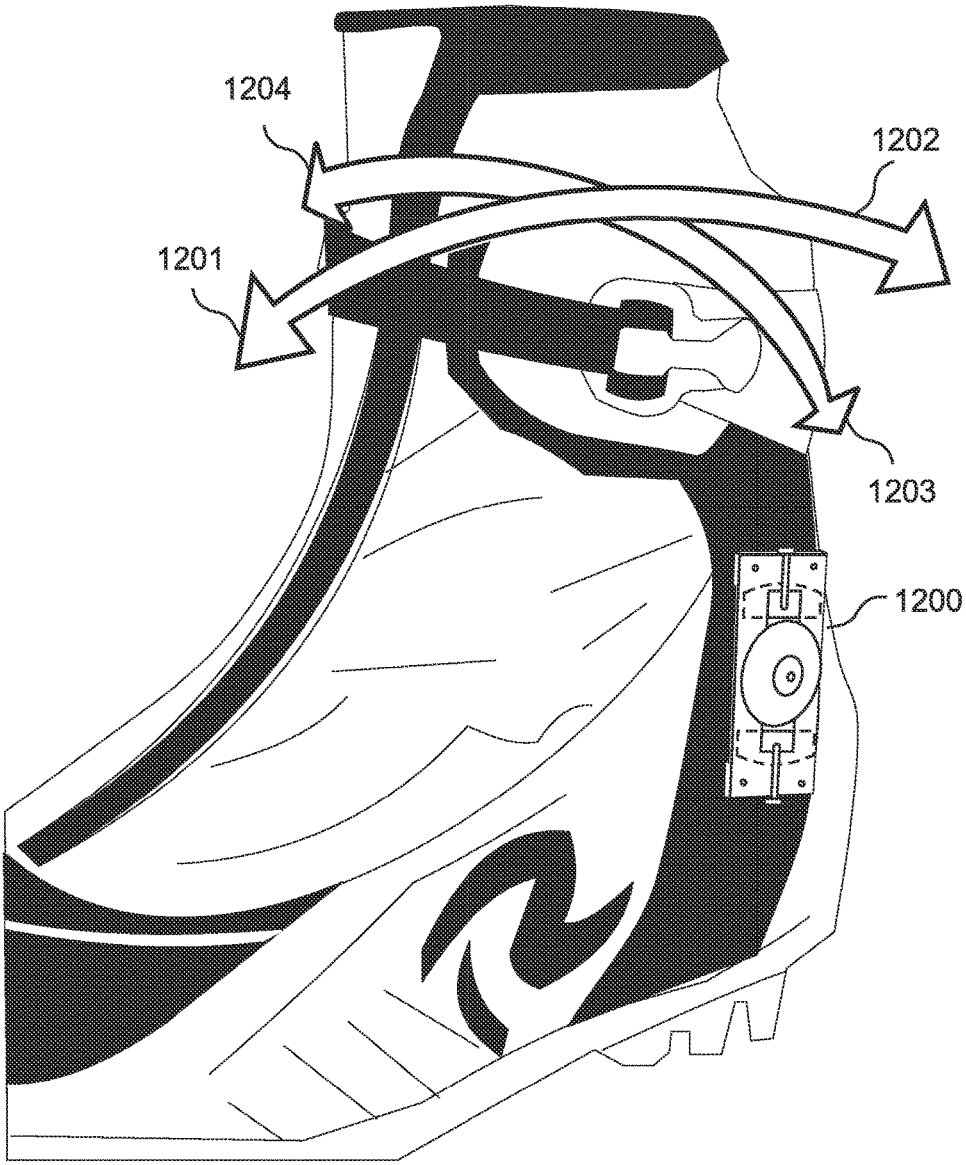
FIG. 12 is a detailed perspective view of the adjustable hinge mechanism of the cuff of FIG. 11.

FIG. 12 shows the cuff mechanism and directions of cuff motion in an embodiment. The cuff in this embodiment moves freely in plantar flexion 1202 and in the normal range of motion of dorsiflexion 1201, which are the traditional planes of motion of Nordic ski boot cuffs. The boot moves freely in plantar flexion 1202. In some embodiments, particularly some in skate boots, dorsiflexion 1201 is limited to the normal range of motion. The cuff also moves in eversion and inversion 1203, 1204. The embodiment of FIG. 12 includes an adjustment mechanism 1200 which allows ankle inversion and eversion over a range which can be adjusted by the user.

Figure 13:
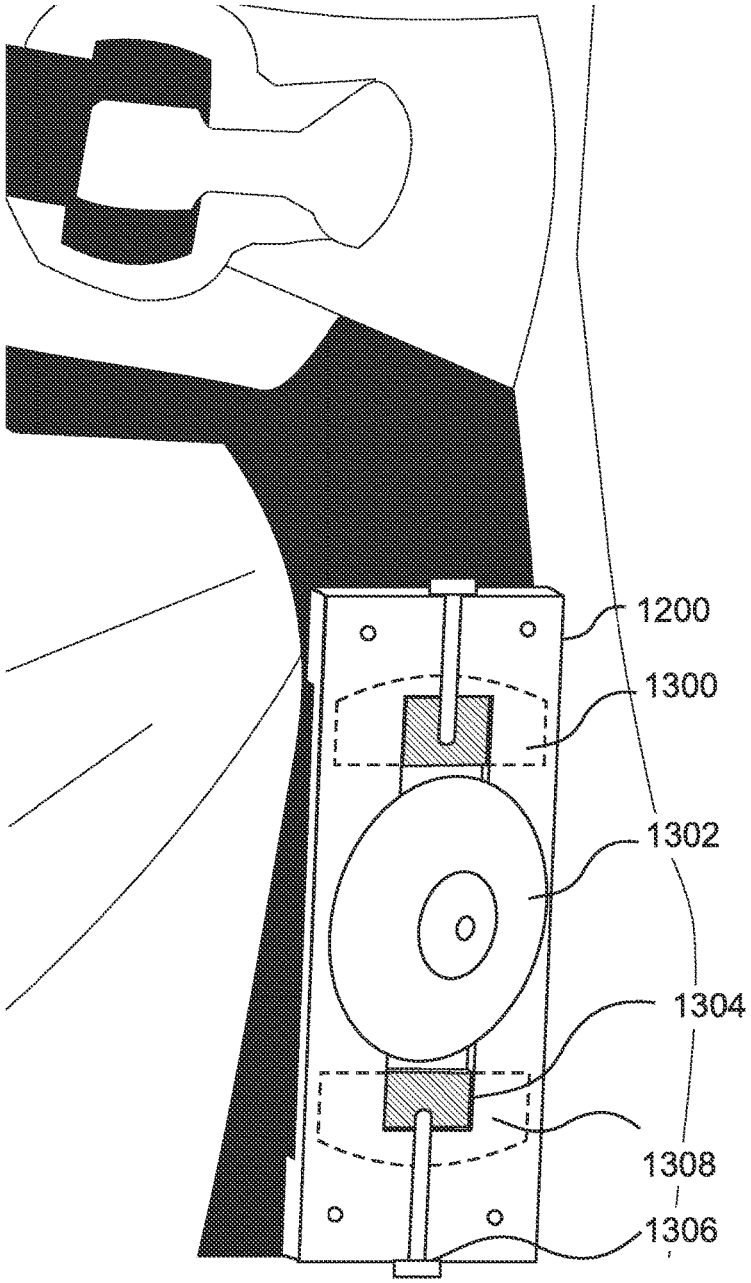
FIG. 13 is close-up perspective view of the adjustable hinge mechanism of the cuff of FIG. 11.

FIG. 13 is a diagram specifically showing the mechanism 1200 of the embodiment of FIG. 12 by which the cuff can be adjusted as to the range of inversion/eversion motion. In FIG. 13, cross-hatching has been included to show the parts of the stops 1300, 1308 that are visible through the slot 1304. The adjustment mechanism 1200 is attached to the cuff 1100, and the circular knob 1302, is part of the lower, heel part 1102 of the boot. The adjustment is done by turning the screws 1306 on the top and bottom. The screws 1306 move horizontal beams 1300, 1308 called "stops." When one of the screws 1306 is turned, the thread inside the stop 1300, 1308 makes the stop move up or down. This stop 1300, 1308 is what the knob that is attached to the lower portion of the boot, hits, to make it stop. The stops 1300, 1308 can be adjusted to allow larger or smaller ranges of movement of the ankle in the eversion/inversion directions, so as to allow the skier to customize the trade-off between mobility and support. In some embodiments, the adjustment mechanisms 1200 are on both sides of the boot, so as to allow the skier to adjust the boot's range of movement in a manner that keeps the axis of movement at the center of the ankle joint. This is done by making the distances of the slides 1304 similar on both sides of the ankle. In some embodiments, the stops 1300, 1308 can be adjusted so as to allow ankle inversion from 0 to 2 degrees and ankle eversion from 0 to 10 degrees. The cuff of FIG. 13 can be adjusted so that there is no inversion or eversion at all, or so that there is slightly greater eversion than that of the normal ankle and slight inversion, or anything in between.

The cuff hinge 1302 in FIG. 13 is located so that it will line up with the area just below the lateral malleolus. This will allow the cuff to form an exoskeleton for the eversion/inversion and the plantar/dorsi flexion, even though these movements are made about two different joints, the talocalcaneal joint and the ankle joint respectively.

In embodiments, the cuff 1100 can be removed by removing the knob 1302. In some of these embodiments the knob 1302 is attached to the lower part of the heel 1102 via a screw that penetrates the lower part of the heel 1102 and the cuff 1100 and enters the knob 1302 from the inside of the boot. The screw head is flush, and between it and the foot are the layer of custom-molded material and the innermost fabric layer of the boot. To turn the screw, the user peels back the covering layers and uses a short stubby screwdriver that fits into the inner diameter of the boot. When the screw is turned, the knob 1302 comes off, the screw can be removed, and then the cuff 1100 and the knob 1302 are detached from the boot. In some of these embodiments a plug is included that can be snapped into the hole left when the screw is removed so as to keep water and snow out of the boot.

Figure 14B:
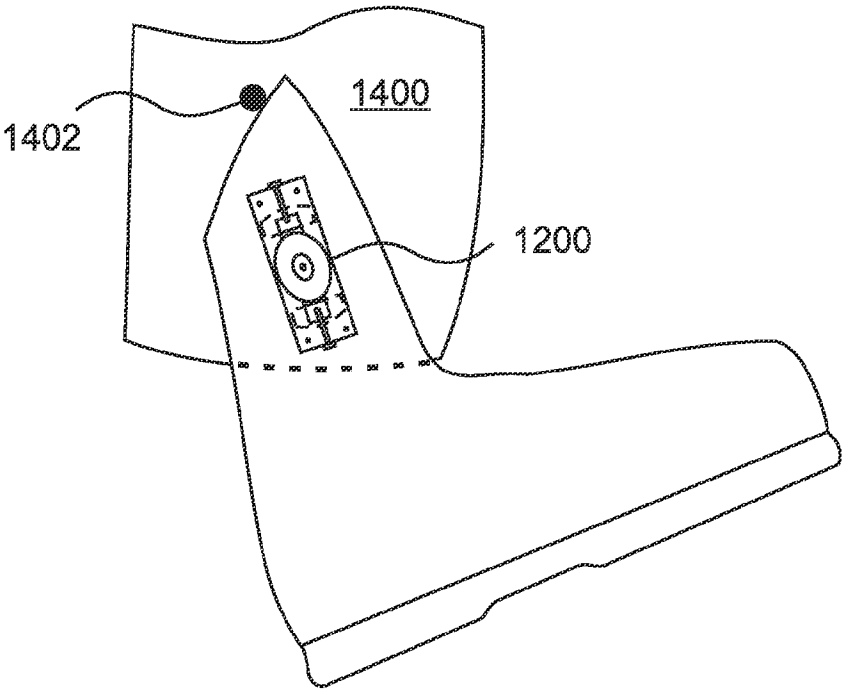
FIG. 14B is a side view illustrating the mechanism of limiting ankle dorsiflexion to the normal range of motion of the joint in an embodiment of the invention.
Figure 14A:
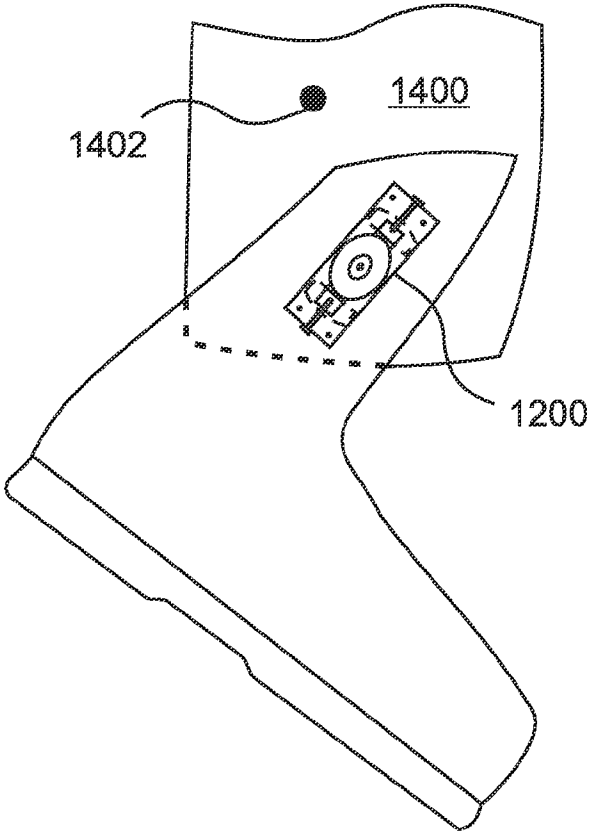
FIG. 14A is a side view illustrating the mechanism of allowing ankle plantar flexion in the normal range of motion of the joint in an embodiment of the invention.
Figure 14C:
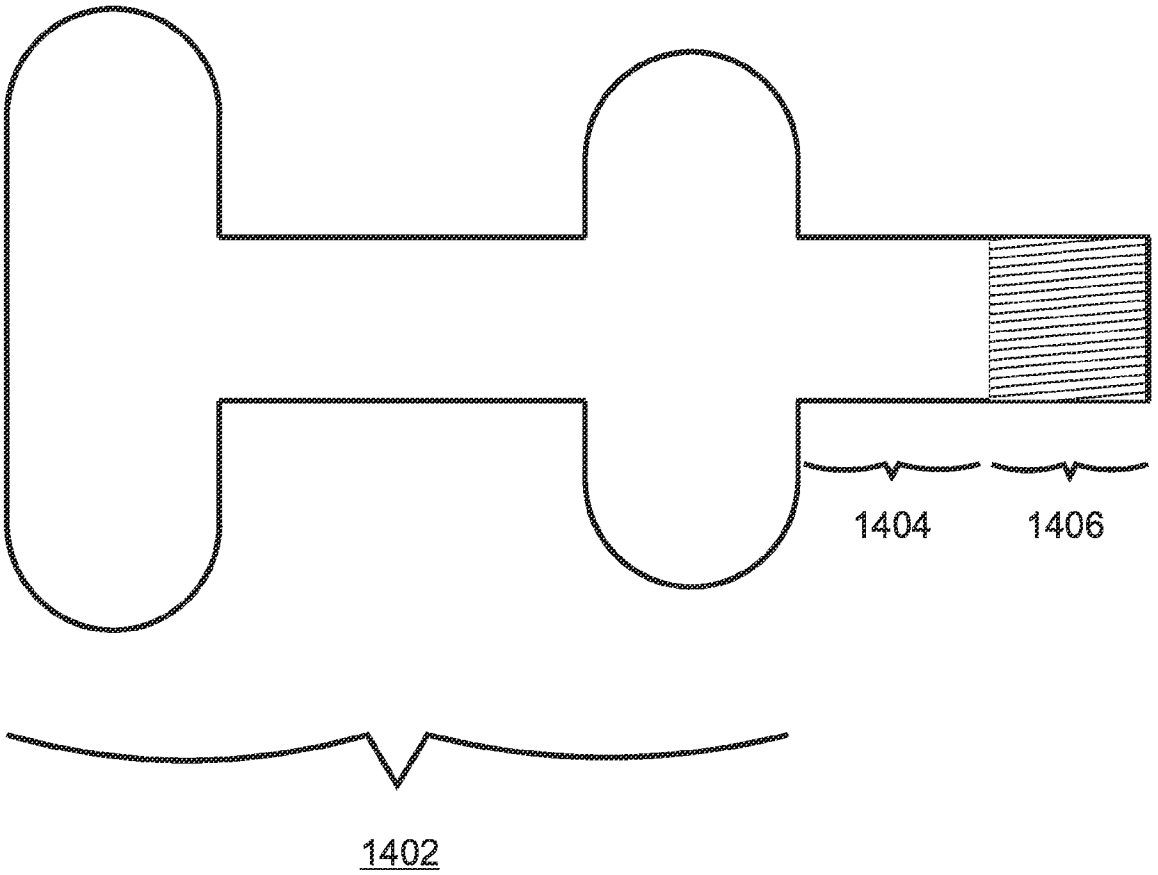
FIG. 14C is a side view of a protrusion included as part of an inversion and eversion limiting cuff in an embodiment of the invention.

FIGS. 14A and 14B show the mechanism by which the cuff 1400 of an embodiment of the regular skate boot of FIG. 13 stops after a normal range of dorsiflexion. There is a small protrusion 1402 on the cuff, to the rear of the hinge 1302, that the cuff hits when it gets to its end range of dorsiflexion, which is when the ankle is at about a 45 degree angle. The cuff allows a full, normal range of dorsiflexion, but prevents dorsiflexion beyond the normal range so as to reduce the risk of dorsiflexion-related ankle injuries in skiers who need that support. Some combi boot embodiments of the present invention do not include that feature because in classic skiing, some skiers use abnormal amounts of ankle dorsiflexion to their advantage, and the risk of ankle injury due to this mechanism is low, since the heel is not attached to the ski. FIG. 14B illustrates dorsiflexion and FIG. 14A shows the plantar flexion. With reference to FIG. 14C, in some embodiments, the protrusion 1402 can be removed as desired by the skier. This can be accomplished with any device, such as a simple screw and lock washer, where the screw's head includes this protrusion. In the embodiment of FIG. 14C, the protrusion 1402 is attached to an extension 1404 that is of the proper length to penetrate the cuff, and a threaded portion 1406 that extends beyond the cuff and mates with a threaded nut (not shown) so as to attach the protrusion 1402 to the cuff.

Figure 15:
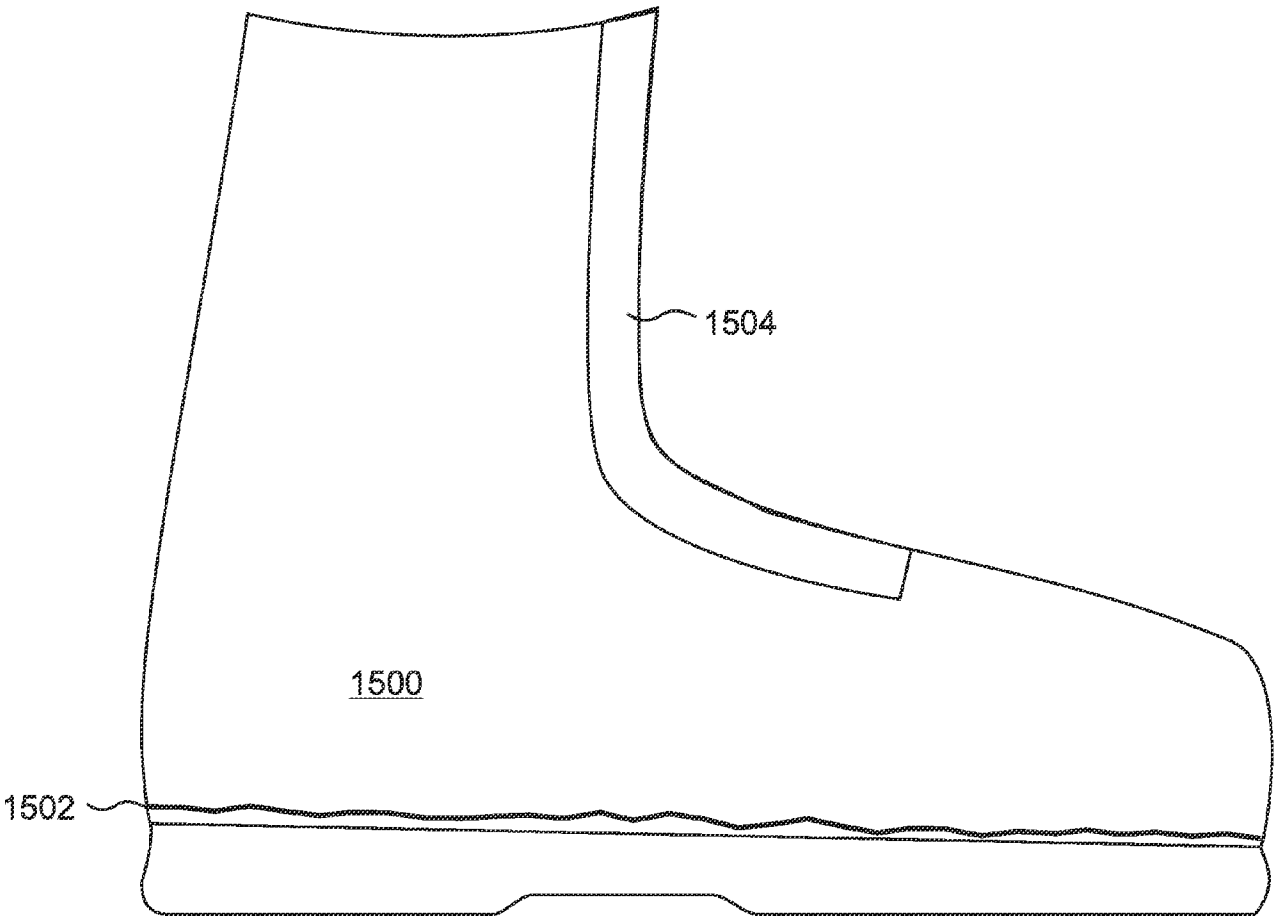
FIG. 15 is a side view illustrating the outermost layer of the embodiment of FIG. 11, which adds warmth and protection from water and is removable for summer roller skiing.

FIG. 15 is a picture of the outermost layer 1500 of the boot in an embodiment wherein the outermost layer is removable. In the embodiment of FIG. 15, the outermost layer includes a water resistant but breathable exterior lined with an insulating material. The outermost layer has a waterproof closure 1504 in the front which covers the laces of the boot. In various embodiments, the waterproof closure is Velcro, or a zipper with a flap (typical of zippers on most outdoor clothing) wherein the flap inhibits water from penetrating the zipper. The outermost layer includes a thick band of elastic 1502 at the base of the boot which is configured so as to keep it snug against the boot.

Figure 16:
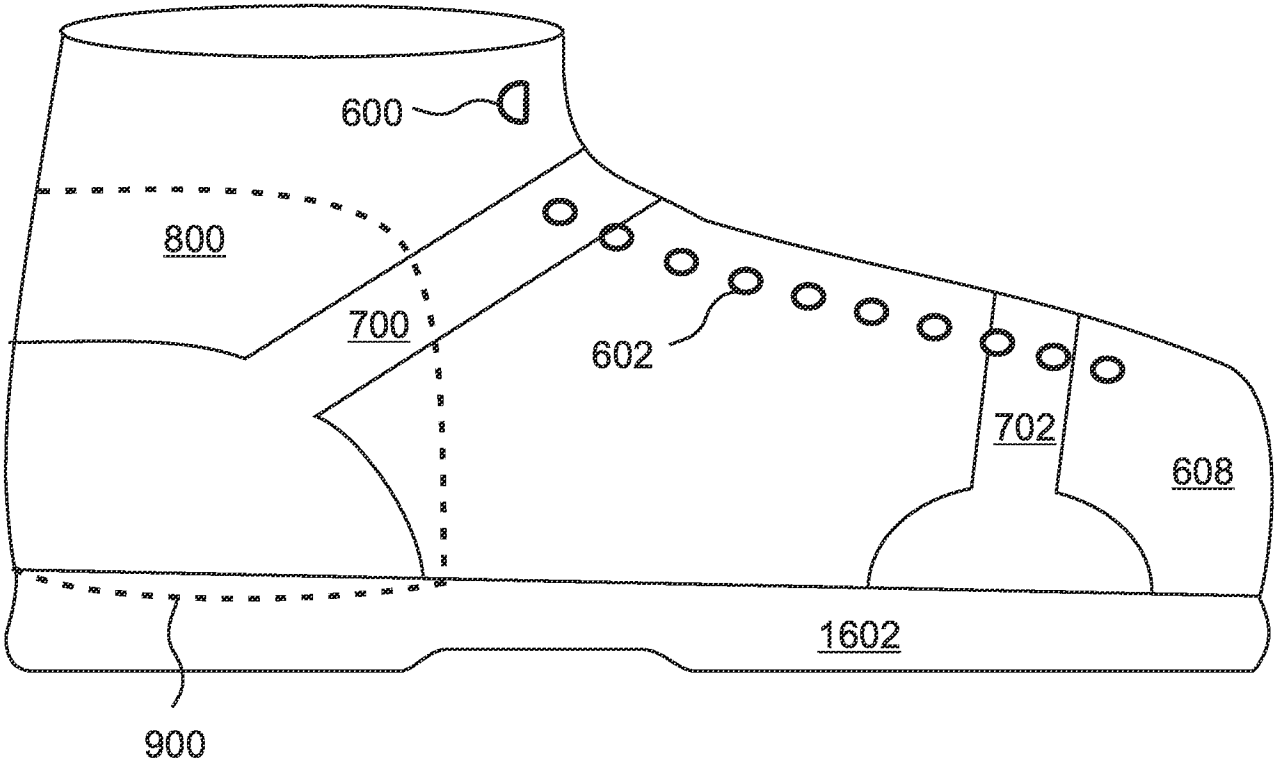
FIG. 16 is a side view illustrating a low-cut embodiment of the invention, which is used for classic and for advanced on-snow skating.

FIG. 16 shows a low-cut embodiment intended for classic skiing and for on-snow skate skiing by strong skiers. This embodiment has a custom fit heel 800 and strap 700 to keep the heel in place; a strap 702 at the ball of the foot that is custom placed fore/aft, either by the shop or manufacturer, or by the user; a custom fit toe box 608 for comfort; a carbon fiber sole 1602; and lacing 602 of the inner layer. Similar embodiments include an overboot (not shown).

Figure 17:
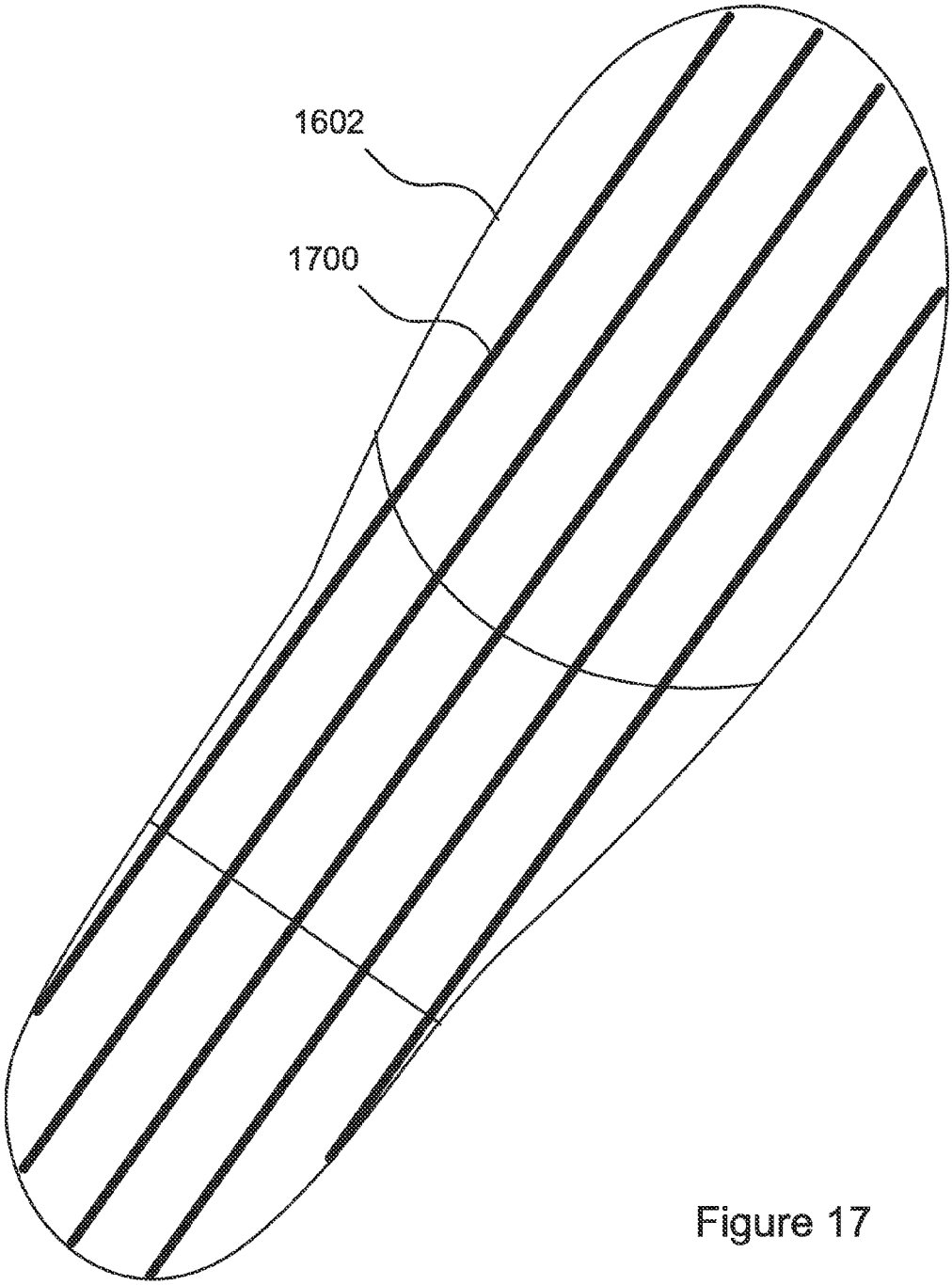
FIG. 17 is a cross-sectional bottom view of a sole of a boot in an embodiment which includes elastic cords in channels located between layers of the sole, whereby the elastic cords assist the boot in springing back to being flat after the ball of the foot is bent.

FIG. 17 is an illustration of an embodiment which includes a set of elastic cords 1700 sandwiched in tunnels between the midsole and the outer sole, so as to help the boot spring back to being flat after the ball of the foot is bent (toe extension). Similar embodiments use spring cables or another device or material known in the art that achieves the same function. The embodiment of FIG. 17 is for skate and combi boots. In some embodiments, elastic cords 1700 such as those shown in FIG. 17 are used in combination with boots for which the soles are made from a plastic material. This also helps to demonstrate the action of a carbon fiber sole designed for the same purpose.

Figure 18A:
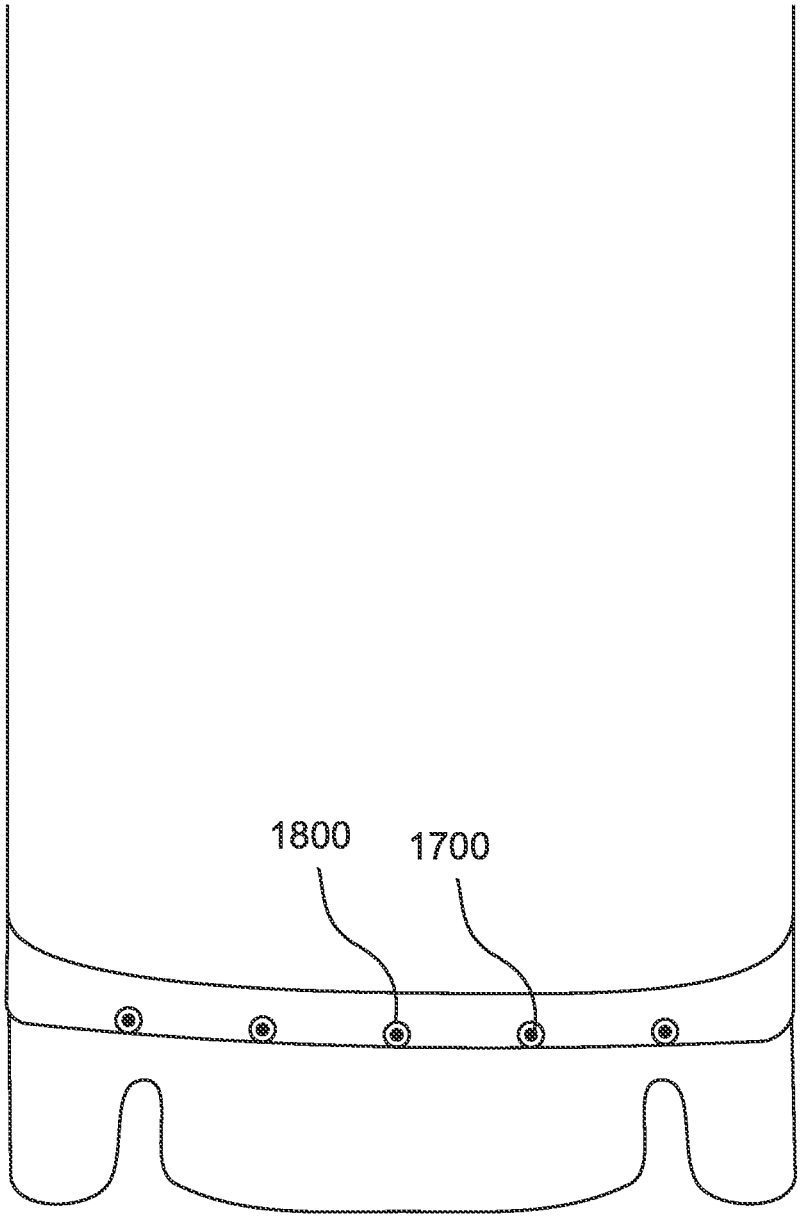
FIG. 18A is a rear cross sectional view of a boot in an embodiment which has elastic cords in channels to help the sole spring back to being flat after the boot is bent at the ball of the foot in toe extension.

FIG. 18A is a rear cross-sectional view of the elastic cords 1700 of FIG. 17, shown as located in tunnels 1800 at the bottom of the midsole.

Figure 18B:
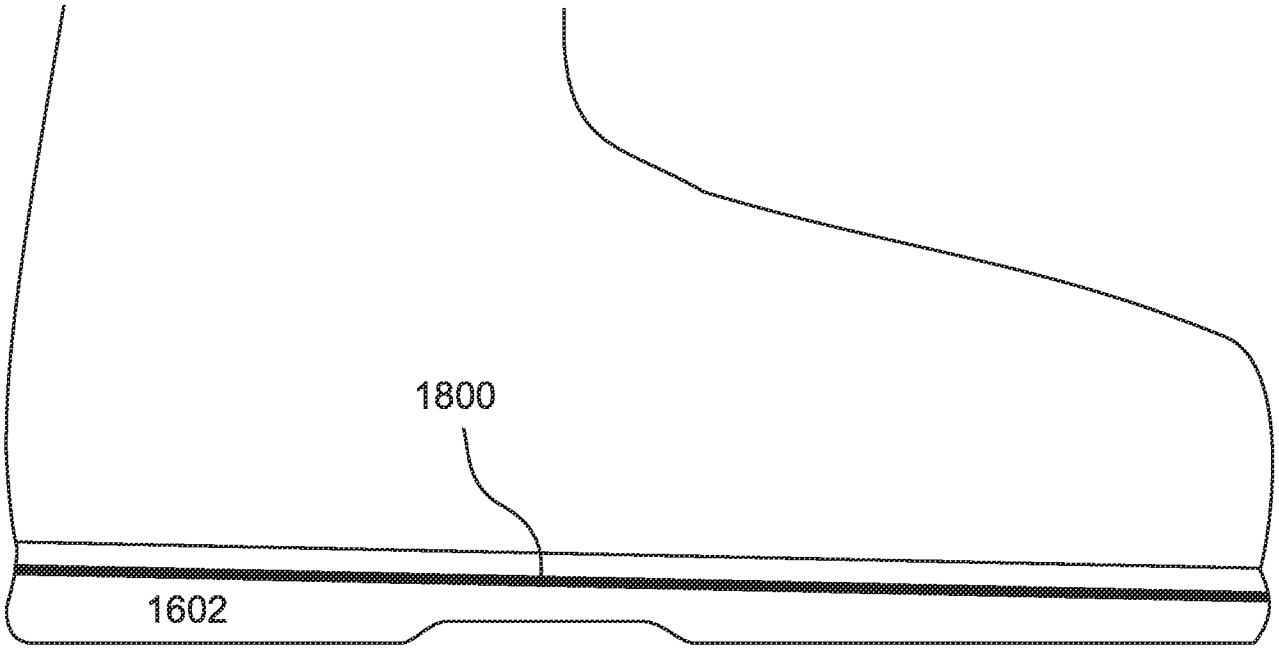
FIG. 18B is a side cross sectional view of the boot of FIG. 18A.

FIG. 18B is a side cross-sectional view of the elastic cords 1700 of FIG. 17. The dark line 1800 represents the tunnels which contain the elastic cords 1700.

Figure 18C:
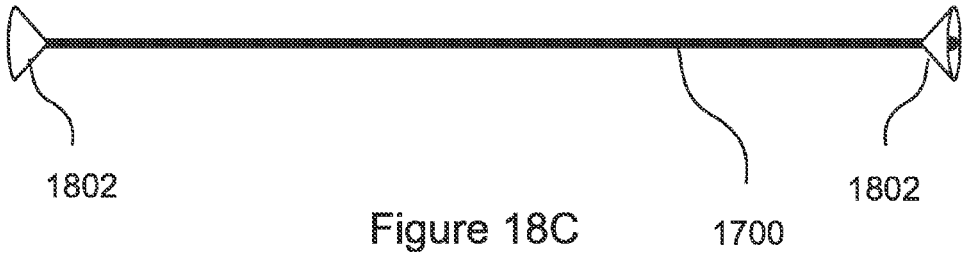
FIG. 18C is a side view of an elastic cord having a cone-shaped attachment on each end.
Figure 18D:
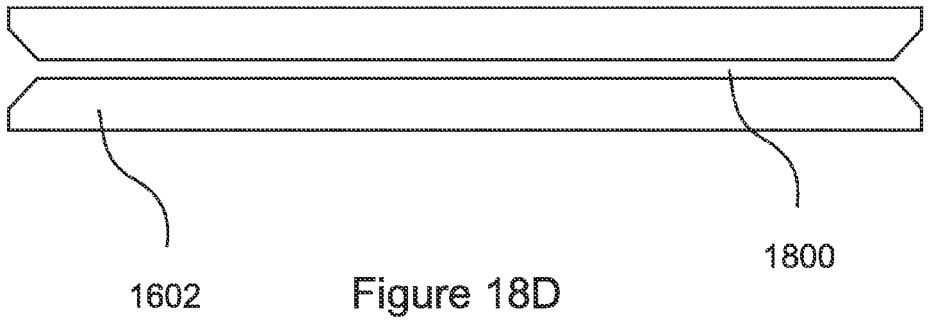
FIG. 18D is a cross-sectional view of a cord channel having cone-shaped counter-sunk ends.
Figure 18E:
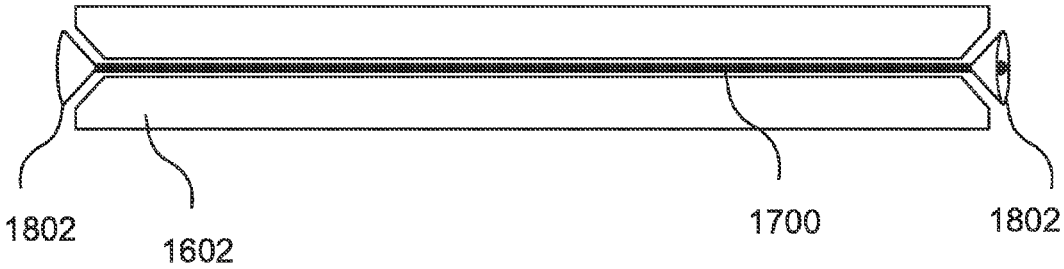
FIG. 18E is a cross sectional view showing the cord of FIG. 18C inserted in the channel of FIG. 18D.

FIGS. 18C-E illustrate an embodiment in which the elastic cords 1700 are removable and replaceable. FIG. 18C is a side view of a stretchy cord 1700 of some kind (elastic or otherwise stretchable) having a cone-shaped attachment 1802 attached to each end of the cord 1700. The cone-shaped attachments 1802 can be metal or any other durable, rigid material. At least one of the cone-shaped attachments 1802 is removable by any mechanism known in the art. In some embodiments at least one of the cone-shaped attachments 1802 has a central hole through the middle of it through which the cord 1700 is threaded, and then secured by tying a knot in the end of the cord 1700 so that it cannot be pulled back out through the hole. When a cord 1700 wears out or breaks, or when a skier wants a cord 1700 of a different strength, the attachment 1802 on at least one end can be removed, the cord 1700 can be pulled out of the tube-shaped hole 1800 in the sole, and a new cord 1700 can be installed.

FIG. 18D is a longitudinal cross section of the long, tube shaped hole 1800 in the sole 1602 of the boot where the cord 1700 can be inserted. The two ends of the hole 1800 are counter-sunk in cone shapes (similar to what would accept the head of a flat-head screw) into which the cone shapes 1802 from the first drawing can fit.

FIG. 18E is a side view of the cord 1700 of FIG. 18C inserted in the hole 1800 of FIG. 18D, the stretchy cord 1700 being attached to the cone shaped attachments 1802, inside the metal tube 1800 with the cone-shape counter sunk ends.

Figure 19A:
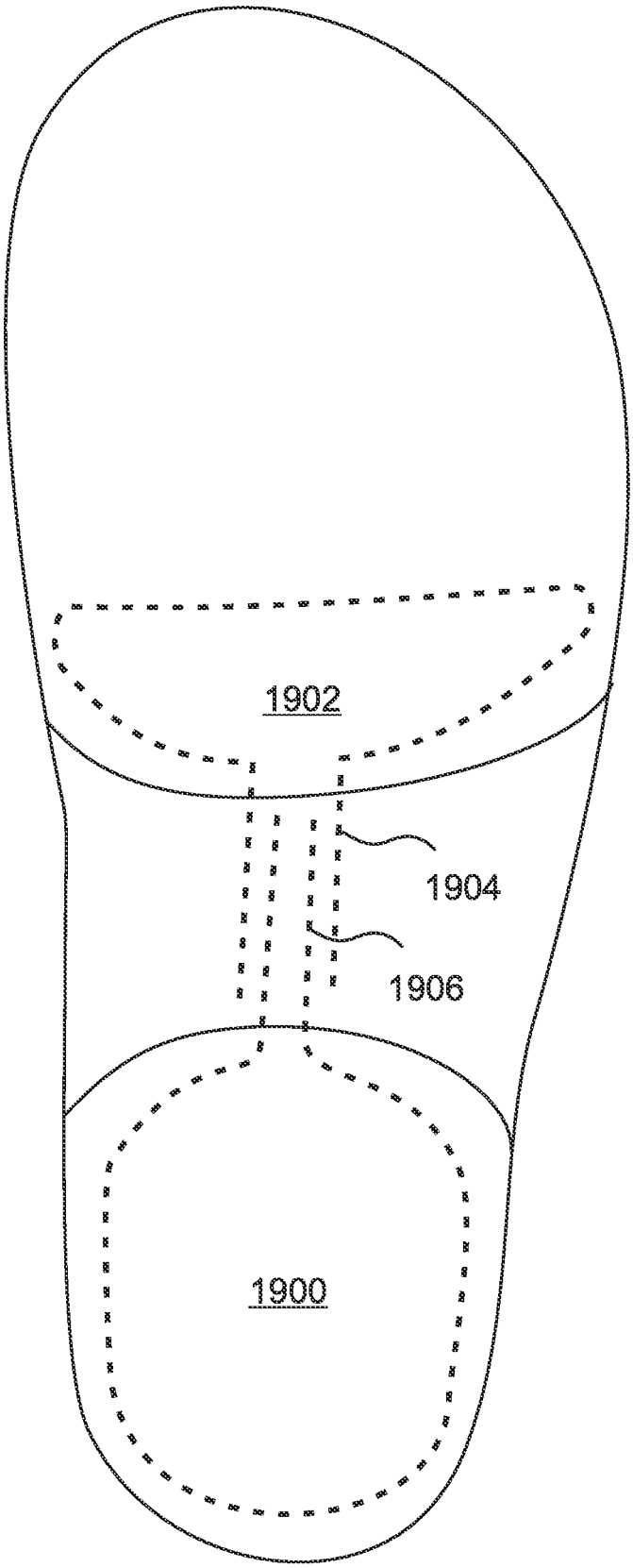
FIG. 19A is a bottom view illustrating a tube and cylinder hinge located in the mid-foot of a sole of an embodiment.
Figure 19B:
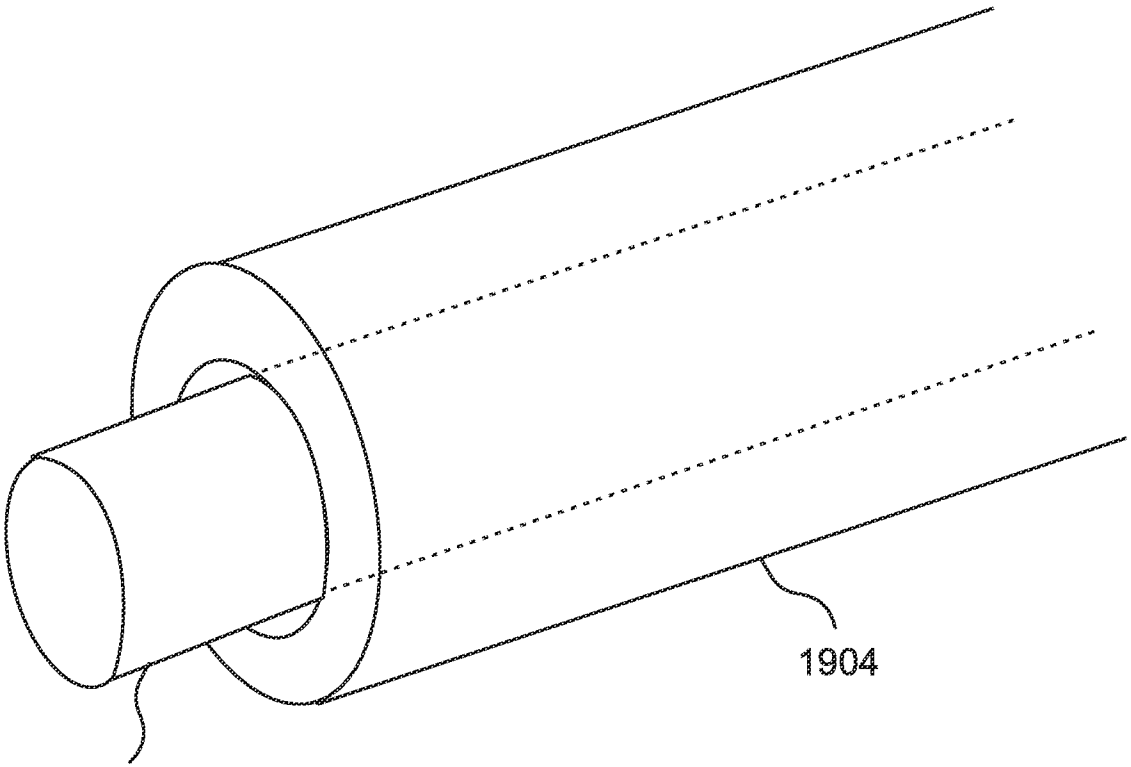
FIG. 19B is a perspective view of the end of a tube and cylinder of the embodiment of FIG. 19A.

FIG. 19A shows a possible cylinder and tube hinge used in some embodiments to help the boot have lateral stiffness while remaining able to twist. The inner cylinder 1906 is tapered to attach to a stiff plate 1900 in the heel, and the outer tube 1904 is tapered to attach to a plate 1902 in the rear of the forefoot area, behind the ball of the foot- or vice versa. FIG. 19B shows that the cylinder 1904 and the tube 1906 are two separate pieces which rotate about each other. This also helps to illustrate the action of a carbon fiber sole designed for this purpose. The boot sole does not twist forward of this area.

Figure 19C:
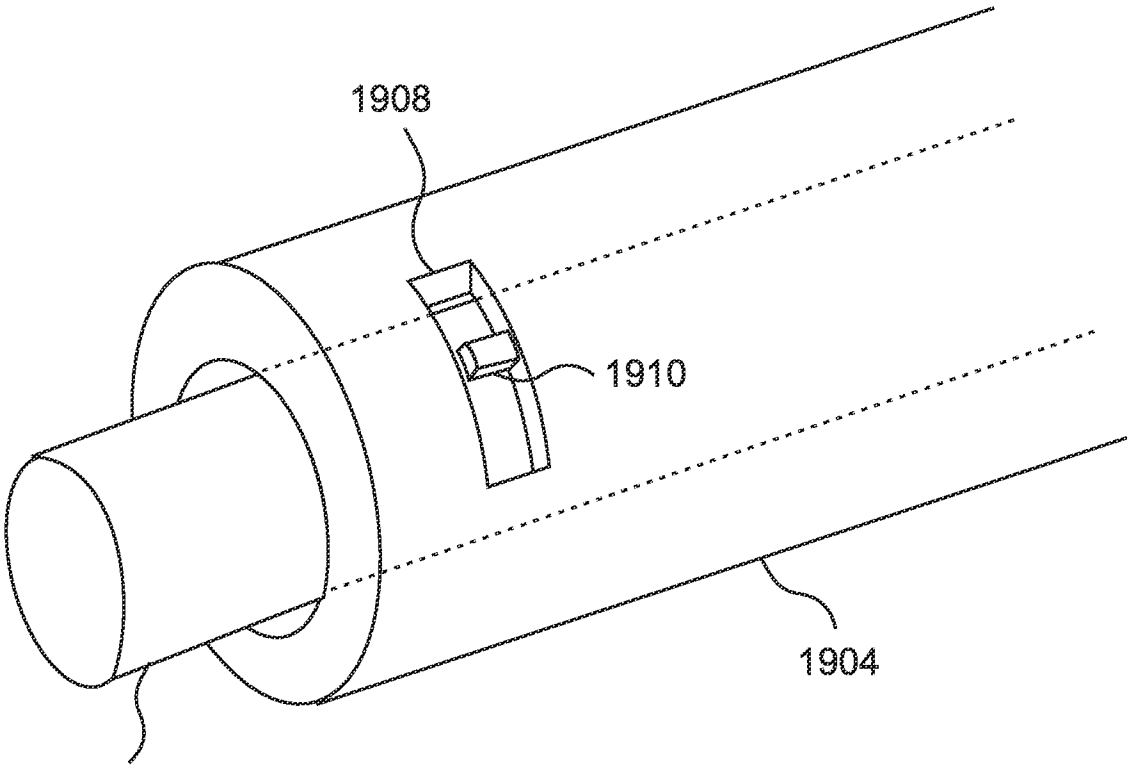
FIG. 19C is a perspective view of a tube and cylinder hinge similar to FIG. 19B, except that a mechanism is included that limits motion of the cylinder within the tube.

FIG. 19C illustrates a mechanism used in an embodiment to limit the range of motion allowed by the cylinder and tube hinge of FIGS. 19A and 19B. A slot 1908 is included in the tube 1904, and a matching protrusion 1910 is included on the cylinder 1906. Movement of the cylinder 1910 within the tube 1904 is thereby limited by the relative sizes and shapes of the slot 1908 and the protrusion 1910. In similar embodiments, an indentation in the inner wall of the tube 1904 is used instead of a slot.

Embodiments of the present invention combine the properties illustrated in FIGS. 17-19 with soles containing carbon fiber. In other embodiments, the features illustrated in FIG. 17-19*b* are implemented in boots made with soles which do not contain carbon fiber.

Table 1 presents a chart comparing features of various embodiments of the present invention. Various embodiments have different combinations of features to best facilitate the types of skiing they are intended for. Classic boots have removable cuffs in some embodiments and not in others, depending on user requirements and usage consitions. For example, classic boot embodiments with cuffs may be appropriate for users with histories of ankle injuries and/or for use in icy conditions.

TABLE 1

| Model | Toe Extension/ Ball Of Foot Flex | Mid-Foot Twist | Cuff | Dorsiflexion Limiter On Cuff |
|---|---|---|---|---|
| Skate-regular | three quarters ≈ 60° ± 10° | full ≈ 20°-25° | yes | yes |
| Classic | full ≈ 80° | half ≈ 10°-15° | in some embodiments | n/a |
| Combi-regular | full ≈ 80° | full ≈ 20°-25° | yes | no |
| Skate-strong skiers on-snow only | three quarters ≈ 60° ± 10° | full ≈ 20°-25° | no | n/a |
| Combi-strong skiers on-snow only | full ≈ 80° | full ≈ 20°-25° | no | n/a |

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A cross country ski boot comprising:

a cross country ski boot having a sole, the cross country ski boot being configured for attachment at a toe area of the boot to a cross country ski by a cross country ski binding, the cross country ski boot being sufficiently flexible to accommodate cross country skiing leg and foot movements by allowing a user to raise a heel of the cross country ski boot off of the cross country ski when the toe area is attached to the cross country ski binding;

a customizable ball attachment mechanism incorporated into the cross country ski boot, the customizable ball attachment mechanism including a first band extending over the ball region of the boot from left and right attachments to the sole, said ball attachment mechanism being capable of maintaining firm and customizable contact between the ball of a user's foot and a ball region of the sole; and a customizable heel attachment mechanism incorporated into the cross country ski boot, the customizable heel attachment mechanism including at least one of a second band extending over an arch region of the boot from left and right attachments to the sole, an inflatable pocket, and a moldable interior material, said heel attachment mechanism being capable of maintaining firm and customizable contact of a user's heel with a heel region of the sole.

2. The cross country ski boot of claim 1, wherein the customizable ball attachment mechanism includes the first band, the first band being adjustable in tightness.

3. The cross country ski boot of claim 2, wherein locations of attachment of the first band to the sole are adjustable by the user.

4. The cross country ski boot of claim 1, wherein the customizable heel attachment mechanism includes a custom moldable material located in the heel region of the boot.

5. The cross country ski boot of claim 1, wherein the customizable heel attachment mechanism includes a concave shaping of the sole of the boot in an interior heel region of the boot, so as to fit the user's heel.

6. The cross country ski boot of claim 1, wherein the customizable heel attachment mechanism includes an inflatable mechanism.

7. The cross country ski boot of claim 1, wherein the customizable heel attachment mechanism includes the second band which extends from a bottom rear location on one side of the heel, over a proximal top of the foot, and down to a bottom rear location on the other side of the heel, thereby helping to maintain the user's heel securely positioned in the boot.

8. The cross country ski boot of claim 1, wherein the boot allows the big toe to go straight forward from the foot.

9. The cross country ski boot of claim 1, wherein a forefoot of the boot, including a toe box region, is custom moldable.

10. The cross country ski boot of claim 1, wherein the sole can be flexed by a flexing force in a vertical direction over a full extension of the user's toes, the sole being configured so as to spring energetically back to a flat configuration when the flexing force is removed.

11. The cross country ski boot of claim 1, wherein the sole can be twisted by a twisting force in a region between a front-of-the-heel region and a ball-of-the-foot region, the sole being configured so as to spring energetically back to a flat configuration when the twisting force is removed.

12. The cross country ski boot of claim 1, wherein the boot includes a forefoot region which is bendable only in a vertical direction, the forefront region being easily bendable over a full range of motion of the ball of the user's foot.

13. The cross country ski boot of claim 1, further comprising a cylinder and tube hinge embedded in a mid-foot region of the boot and configured to rotate about a common axis, said common axis being oriented in a direction that extends from the heel region of the sole to the toe region of the sole, the cylinder and tube hinge being configured to enhance a twistability and lateral stiffness in a mid-foot region of the boot.

14. The cross country ski boot of claim 1, further comprising a groove along both sides of the boot and surrounding the heel of the boot, the groove being configured to retain an elastic cord which is attachable to a ski binding, the elastic cord being thereby configured to assist in returning the boot to a flat configuration against a ski when the boot is flexed about the ball of the user's foot and the heel of the boot is lifted from the ski.

15. The cross country ski boot of claim 1, wherein only minimal force is required to flex the boot about the ball of the user's foot.

16. The cross country ski boot of claim 1, wherein the boot is cut so as not to extend above the ankle of a user, the ankle being thereby free to move without hindrance by the boot.

17. The cross country ski boot of claim 1, wherein the boot is configured to bend about a forward bending region surrounding the ball of the user's foot, the forward bending region having a bending area on a big toe side which is larger than a bending area on a little toe side, the forward bending region being thereby configured to bend in a pattern that corresponds with an anatomical bending movement of the foot, the forward bending region being thereby configured to maintain the foot in alignment with an attached ski and binding as the ball of the foot bends.

18. The cross country ski boot of claim 1, further comprising a plurality of extendible cords contained in tunnels within the sole between a mid region of the sole and an outer region of the sole, the extendible cords tending to energetically retract to their non-extended lengths when released, the extendible cords being configured to help the boot spring back to being flat after the ball of the foot is bent.

19. The cross country ski boot of claim 1, wherein the boot allows eversion of a forefoot of a user relative to a hindfoot of the user, but does not allow inversion of the forefoot of the user relative to the hindfoot of the user.

20. The cross country ski boot of claim 1, wherein the customizable ball attachment mechanism is distinct from the customizable heel attachment mechanism.

21. The cross country ski boot of claim 1, wherein a stiff region in the area of the sole that is in front of the ball of the foot extends from the ball of the foot to the cross country ski binding.

22. A cross country ski boot comprising:

a cross country ski boot having a sole, the cross country ski boot being configured for attachment at a toe area of the boot to a cross country ski by a cross country ski binding, the cross country ski boot being sufficiently flexible to accommodate cross country skiing leg and foot movements by allowing a user to raise a heel of the cross country ski boot off of the cross country ski when the toe area is attached to the cross country ski binding;

a cuff adapted to be attached to the user's lower leg;

a rigid outer shell attached to sides of the heel of the cross country ski boot, a distance between the cuff and the rigid outer shell being variable during eversion and inversion; and adjustable means for limiting an eversion and inversion angle by limiting the variation of the distance between the cuff and the rigid outer shell during eversion and inversion to a defined range, thereby allowing full plantar flexion of the cross country ski boot and a determined range of motion of dorsiflexion of the boot, while limiting foot eversion and inversion to defined ranges.

23. The cross country ski boot of claim 22, wherein the eversion and inversion limiting mechanism includes range limiting mechanisms located on at least one side of the cuff.

24. The cross country ski boot of claim 22, wherein the eversion and inversion limiting mechanism is adjustable by the user.

25. The cross country ski boot of claim 22, wherein the cuff is removable.

26. A sole for a cross country ski boot, said sole being twistable and vertically flexible, while preventing side-to-side lateral bending thereof.

27. The sole for a cross country ski boot of claim 26, wherein the sole includes a cylinder and tube hinge embedded in a mid-foot region of the sole and configured to rotate about a common axis, said common axis being oriented in a direction that extends from a heel region of the sole to a toe region of the sole, the cylinder and tube hinge being configured to enhance a twistability and lateral stiffness in a mid-foot region of the sole while preventing side-to-side lateral bending thereof.

* * * * *